US008955258B2

(12) United States Patent
Jacques et al.

(10) Patent No.: US 8,955,258 B2
(45) Date of Patent: Feb. 17, 2015

(54) TRANSPORTABLE IMMERSIVE MOTION PICTURE DISPLAY STRUCTURES

(75) Inventors: G. Eric Jacques, Ontario (CA); Denis G. Tremblay, Ontario (CA); Paul Kucera, Ontario (CA); Brian J. Bonnick, Ontario (CA)

(73) Assignee: Imax Corporation, Mississauga, Ontario (CA)

( * ) Notice: Subject to any disclaimer, the term of this patent is extended or adjusted under 35 U.S.C. 154(b) by 0 days.

(21) Appl. No.: 13/821,591

(22) PCT Filed: Sep. 9, 2011

(86) PCT No.: PCT/US2011/050989

§ 371 (c)(1),
(2), (4) Date: Mar. 8, 2013

(87) PCT Pub. No.: WO2012/034011

PCT Pub. Date: Mar. 15, 2012

(65) Prior Publication Data

US 2013/0167452 A1 Jul. 4, 2013

Related U.S. Application Data

(60) Provisional application No. 61/381,549, filed on Sep. 10, 2010.

(51) Int. Cl.
*E04B 1/34* (2006.01)
*E04H 3/30* (2006.01)
(Continued)

(52) U.S. Cl.
CPC .. *E04H 3/30* (2013.01); *E04H 3/22* (2013.01); *E04H 15/20* (2013.01); *E04B 1/34357* (2013.01)
USPC ..... 52/2.18; 52/2.11

(58) Field of Classification Search
CPC ..... E04H 15/20; E04H 2015/207
USPC ..... 52/2.18, 2.11, 2.14, 2.25
See application file for complete search history.

(56) References Cited

U.S. PATENT DOCUMENTS 3,154,888 A * 11/1964 Graham ..... 52/81.4
D202,547 S 10/1965 Kwake (Continued)

FOREIGN PATENT DOCUMENTS

CA 1 329 973 6/1994
CA 2 212 770 2/1999

(Continued)

OTHER PUBLICATIONS

International Search Report and Written Opinion Corresponding to International Application No. PCT/US2011/050989; Date of Mailing: Jul. 16, 2013; 23 Pages.

(Continued)

*Primary Examiner* — Basil Katcheves
(74) *Attorney, Agent, or Firm* — Myers Bigel Sibley & Sajovec, P.A.

(57) ABSTRACT

A transportable large capacity theatre includes a primary theatre body with laterally spaced apart first and second long sides, opposing first and second ends attached to the long sides, and a roof over the long sides and ends, the body defining an enclosed interior chamber. The roof, the long sides and the ends may be defined by a plurality of laterally extending inflated tubes, and the long sides of the primary theatre body may have a substantially vertical orientation relative to a surface on which theatre may be supported for at least a major portion of the height of the respective long sides. The theatre further includes a seating section, a display screen positioned in the interior of the primary theatre body and viewable by a viewer seated in the seating section, and a projection system in the interior of the primary theatre body and in communication with the screen.

20 Claims, 21 Drawing Sheets

(51) Int. Cl.

| | |
|---|---|
| ***E04H 3/22*** | (2006.01) |
| ***E04H 15/20*** | (2006.01) |
| ***E04B 1/343*** | (2006.01) |

(56) References Cited

U.S. PATENT DOCUMENTS

| | | | | | |
|---|---|---|---|---|---|
| 3,390,491 | A | | 7/1968 | Hayden et al. | |
| 3,497,606 | A | * | 2/1970 | La Andrews et al. | 174/379 |
| D220,686 | S | | 5/1971 | Stineman | |
| 3,742,657 | A | * | 7/1973 | Price | 52/2.14 |
| 3,779,847 | A | * | 12/1973 | Turner | 156/156 |
| 4,000,749 | A | * | 1/1977 | Busco | 600/21 |
| 4,099,351 | A | * | 7/1978 | Dalo et al. | 52/2.25 |
| 4,384,435 | A | * | 5/1983 | Polise et al. | 52/2.19 |
| 4,932,169 | A | * | 6/1990 | Charbonneau | 52/2.18 |
| 4,976,074 | A | | 12/1990 | Delamare | |
| 5,097,548 | A | | 3/1992 | Heck et al. | |
| D363,993 | S | * | 11/1995 | Johnson et al. | D25/19 |
| D369,670 | S | | 5/1996 | Queen | |
| 5,526,610 | A | | 6/1996 | Delamare | |
| 6,065,252 | A | | 5/2000 | Norsen | |
| 6,332,290 | B1 | | 12/2001 | Delamare | |
| 6,810,896 | B2 | | 11/2004 | Ueda et al. | |
| D549,836 | S | | 8/2007 | Desbiens | |
| 2002/0001064 | A1 | | 1/2002 | Graves et al. | |
| 2006/0277830 | A1 | | 12/2006 | Boggs, Jr. | |
| 2010/0146868 | A1 | | 6/2010 | Lukasiewicz et al. | |

FOREIGN PATENT DOCUMENTS

| | | | |
|---|---|---|---|
| CA | 2 678 155 | | 10/2008 |
| DE | 69 22 678 | | 1/1970 |
| DE | 16 25 368 | A1 | 6/1970 |
| DE | 38 81 818 | T2 | 1/1994 |
| DE | 20 2009 003309 | U1 | 6/2009 |
| EP | 0 859 105 | A1 | 8/1998 |
| FR | 2 399 511 | A1 | 3/1979 |
| FR | 2 535 658 | A1 | 5/1984 |
| FR | 2 677 066 | A1 | 12/1992 |
| GB | 2 368 599 | | 5/2002 |
| WO | WO 93/11330 | | 6/1993 |
| WO | WO 03/055718 | A1 | 7/2003 |

OTHER PUBLICATIONS

International Preliminary Report on Patentability Corresponding to International Application No. PCT/US2011/050989; Date of Mailing: Aug. 1, 2013; 17 Pages.

* cited by examiner

TRANSPORTABLE IMMERSIVE MOTION PICTURE DISPLAY STRUCTURES

CROSS-REFERENCE TO RELATED APPLICATION

This application is a 35 U.S.C. 371 national stage application of PCT International Application No. PCT/US2011/050989, filed on 9 Sep. 2011, which claims the benefit of and priority to U.S. Provisional Patent Application No. 61/381,549, filed Sep. 10, 2010, entitled "TRANSPORTABLE IMMERSIVE MOTION PICTURE DISPLAY STRUCTURES AND METHODS," the disclosure of which is hereby incorporated herein by reference in its entirety. The above-referenced PCT International Application was published in the English language as International Publication No. WO 2012/034011 on 15 Mar. 2012.

BACKGROUND

The present invention relates to motion picture theatres, and in particular to transportable theatres capable of providing immersive motion picture display experiences to audiences.

Some considerations in the design of facilities for motion picture exhibition include the dimensions of the theatre enclosure, the design and positioning of seats within the enclosure, the size of the screen upon which images are projected, the aspect ratio of the images for presentation, the format of the audio soundtrack that accompanies the motion picture, the configuration of the audio system, and the placement of loudspeakers within the theatre.

Early systems for motion picture exhibition used 35 mm wide film. As motion picture theatres evolved in size from smaller theatres to larger theatres, motion picture producers and exhibitors started experimenting with larger film formats which could enhance the visual impact of the motion picture. Various attempts were made to improve the visual experience of the motion picture patron by expanding the aspect ratio of the screen. However, these attempts were unsuccessful at creating a truly immersive, commercially successful, motion picture experience.

Beginning in 1969, and led by IMAX Corporation, motion picture producers began using horizontally travelling 70 mm film with a film frame of 15 perforations in width, resulting in an image area about ten times that of standard 35 mm film. In addition to using a larger film format, IMAX® re-conceptualized the theatre viewing space by providing significantly larger screens which extended the spectators' fields of view, a steeply raked seating area to give unobstructed viewing of the large screen, and high fidelity, discrete six channel sound to surround the audience. The net result of these advances was a theatre experience in which audience members were immersed in image and sound as never before.

In most cases IMAX® systems were installed in custom designed motion picture theatres having a large interior volume to house both the large screen and a steeply raked seating section. Occasionally, IMAX® projection systems were placed in theatres converted from buildings originally designed for conventional theatrical or motion picture exhibitions. However, in converted theatres, it was sometimes necessary to remove some seats because the visual quality at some locations was poor. Furthermore, in some converted theatres, the slope, or rake, of the seats was relatively shallow, resulting in less than optimal viewing conditions.

SUMMARY

A transportable large capacity theatre according to some embodiments includes a primary theatre body with laterally spaced apart first and second long sides, opposing first and second ends attached to the long sides, and a roof over the long sides and ends. The body defines an enclosed interior chamber. The theatre further includes a seating section, a display screen positioned in the interior of the primary theatre body and viewable by a viewer seated in the seating section, and a projection system in the interior of the primary theatre body and in visual communication with the screen.

The roof, the long sides and the ends may be defined by a plurality of laterally extending inflated tubes. The long sides of the primary theatre body may have a substantially vertical orientation relative to a surface on which the theatre is supported for at least a major portion of the height of the respective long sides. The first and second long sides may taper in height from the first end to the second end at an angle of at least about 2 degrees.

The first and second long sides may taper in height from the first end to the second end a distance of at least about 20 feet from the first end to the second end.

The seating section may include seats for at least 400 patrons.

The screen may have a width of about 60 feet to about 80 feet and may reside proximate an end of the primary theatre body.

The projection system includes a projector that may be held on a base that may be coupled to a lifting device configured to lift the projector to a height of at least about 20 feet.

The transportable large capacity theatre may further include an inflatable antechamber that may be releasably attached to the primary theatre body.

The primary theatre body may include at least one passageway adjacent a base of the primary theatre body, and the inflatable antechamber may be positioned adjacent the passageway to define an entrance/exit vestibule for the primary theatre body.

The inflatable antechamber may be releasably attachable at a plurality of locations on an exterior of the primary theatre body.

The transportable large capacity theatre may further include a sheath or lining covering a surface of the primary theatre body.

The lining may include an interior lining that defines a volume within the primary theatre body that includes the screen and the seating section.

The projector may be positioned outside the volume defined by the interior lining, and the transportable large capacity further includes a plurality of loudspeakers positioned within the primary theatre body and outside the volume defined by the interior lining.

The projector may be positioned within the volume defined by the interior lining, and the transportable large capacity may further include a plurality of loudspeakers positioned within the primary theatre body and within the volume defined by the interior lining.

The first and second long sides may be tapered inward toward a centerline of the primary theatre body from the first end to the second end, where the centerline bisects the screen.

The first and second long sides may be tapered outward away from a centerline of the primary theatre body from the first end to the second end, where the centerline bisects the screen.

The transportable large capacity theatre may further include an audio system coupled to the projection system and including a plurality of loudspeakers. The plurality of loudspeakers includes at least a first loudspeaker positioned on a side of the screen opposite the seating section and a second loudspeaker positioned beneath the seating section.

The first and second long sides may have a shortest height of between about 40 feet to about 60 feet and a length between about 70 feet and 150 feet.

A transportable projection system according to some embodiments includes a container having sidewalls and a bottom, a cradle disposed within the container, a lifting system disposed within the container and configured to move the cradle between an extended position and a retracted position, and a motion picture projector in the cradle.

The projection system may include a fixed raised platform structure on the container to place the projector and cradle when in the extended position.

When the base is in the retracted position, the motion picture projector may be disposed entirely within an interior of the container, and when the base is in the extended position, at least a lens of the projector may be positioned in a projecting location suitable for projecting an image onto a remote viewing surface that may be remote from the projection system.

The projection system may further include a retractable seating section coupled to an external side of the container.

The projection system may further include a plurality of stabilizing arms coupled to the container and extending laterally therefrom, each stabilizing arm including an associated stabilizing foot configured to contact a surface beneath the container to stabilize the container.

The stabilizing arms and stabilizing feet may be configured to support an entire weight of the projection system.

An inflatable structure according to some embodiments includes a primary body with laterally spaced apart first and second long sides, opposing first and second ends attached to the long sides, and a roof over the long sides and ends. The body defines an enclosed interior chamber, and the roof, the long sides and the ends may be defined by a plurality of inflatable tubes. At least some of the inflatable tubes include at least two layers that may be opaque to light.

At least some of the inflatable tubes include an outer layer configured to reflect external light away from the interior chamber, a first internal layer that may be opaque to light, a second internal layer that may be opaque to light, and an inner layer that may be configured to absorb light.

A surface of the inflatable tubes facing the enclosed interior chamber may be configured to absorb light.

The long sides of the primary body may have a substantially vertical orientation relative to a surface on which the structure may be supported for at least a major portion of the height of the respective long sides.

The first and second long sides taper in height from the first end to the second end.

The first and second long sides taper in height from the first end to the second end by an angle of about 2 degrees.

The inflatable structure may further include an exterior and/or interior lining covering a surface of the primary body.

The first and second long sides may be tapered inward toward a centerline of the primary theatre section from the first end to the second end, where the centerline bisects a viewing screen positioned at the first end of the primary body.

The first and second long sides may be tapered outward away from a centerline of the primary body from the first end to the second end, where the centerline bisects a viewing screen positioned at the first end of the primary body.

A transportable theatre system according to some embodiments includes an exterior shell including a flexible material that defines a first inner volume within the exterior shell, and an inner shell including a second material within the exterior shell that defines a second inner volume within the inner shell, so that the second inner volume is enclosed by the first inner volume. The second inner volume may be configured to provide an immersive cinematic experience to a patron seated within the second inner volume.

The inner shell may be mechanically supported independent of the exterior shell.

A volume of space between the exterior shell and the inner shell houses audiovisual systems that provide the immersive cinematic experience within the second inner volume.

The transportable theatre system may further include a seating section within the second inner volume, and a viewing screen within the second inner volume and configured to display a visual image to a patron seated in the seating section.

The inner shell forms a volume that may have a side wall that extends along a side of the seating section and may be proximate to a side edge of the viewing screen and an inner shell ceiling that extends over the seating section and may be proximate to a top edge of the viewing screen.

The side wall may be proximate to the side edge of the viewing screen and the ceiling may be proximate to the top edge of the viewing screen.

The inner shell ceiling may slope up to the top of the top edge of the viewing screen from a back of the theatre opposite the viewing screen to a front of the theatre proximate to the viewing screen.

In some embodiments, the inner shell ceiling may be horizontal.

The inner shell includes side walls on opposing sides of the viewing screen, the side walls may be spaced a same distance apart from one another at a back of the theatre opposite the viewing screen as at a front of the theatre proximate to the viewing screen.

The inner shell material includes a flexible material or a rigid material.

In some embodiments, the inner shell material includes scrim.

The exterior shell may be an inflatable structure.

A shape of the inner shell can be configured to form different volumes and shapes within the exterior shell.

The inner shell material may include a thermally insulating material.

The exterior shell and the inner shell cooperatively function to shield the second inner volume from light incident on an outer surface of the exterior shell to substantially preclude pinhole light or other light that may penetrate through the exterior shell from reaching the second inner volume.

The exterior shell includes first and second opaque layers of material that may be spaced a predetermined distance apart. Light passing through a pin hole lens in the first opaque layer of material may be blocked by the second opaque layer of material in the external shell.

The exterior shell provides a barrier to weather precipitate and outside light and the inner shell may be configured to reduce sound reflections within the second inner volume.

The transportable theatre system may be configured to be disassembled, transported and reassembled.

A transportable theatre system according to some embodiments includes an exterior shell including a flexible material that defines an inner volume therein, a viewing screen positioned within the inner volume, a seating section positioned within the inner volume in a spaced relation to the screen and configured to permit a viewer seated in the seating section to view the viewing screen, a motion picture projector positioned within the inner volume and configured to project an image onto the viewing screen, a wall within the inner volume adjacent the seating section, and a ceiling within the inner volume above the seating section. A portion of the wall proximate the viewing screen may have a similar vertical dimension as the viewing screen and extends from the screen towards the seating section to the extent of at least covering a side area that can be seen in the peripheral vision of a viewer seated in any position in the seating section when viewing an image on the viewing screen. A portion of the ceiling near the viewing screen may have a similar horizontal dimension as the viewing screen and extends from the screen towards the seating section to the extent of at least covering a top area that can be seen in the peripheral vision of a viewer seated in any position in the seating section when viewing an image on the viewing screen. The wall, the ceiling and the screen cooperatively create an immersive cinematic experience, and the external shell, the wall, the ceiling, the seating section and the screen may be configured to be disassembled and transported.

The wall and the ceiling may be extended towards the seating section to the extent of at least covering a side and top area that can be seen in the peripheral vision of a viewer seated in any position in the seating section when viewing an image on the viewing screen.

The sidewalls may be spaced apart the same distance at the front of the screen as at the back towards the seating section and the ceiling may be horizontal.

The sidewalls may be spaced apart the same distance at the front of the screen as at the back towards the seating section and the ceiling slopes from the seating section up to the screen.

A transportable theatre according to some embodiments includes an exterior shell comprising a flexible material that defines a first volume of space within the exterior shell, and a theatre presentation system within the second volume. The theatre presentation system includes a seating section, a screen viewable by a viewer seated in the seating section, and a projection system configured to display an image on the screen. The transportable theatre further includes a second layer of material interposed between the exterior shell and a portion of the theatre presentation system. The transportable theatre is configured to be disassembled, transported and reassembled at a remote location.

The transportable theatre may include an exterior lining covering an outside surface of the exterior shell. The second layer may include a flexible skin.

The flexible material of the exterior shell may include a first opaque layer and the second layer of material may include a second opaque layer. The first and second opaque layers cooperatively shield the theatre presentation system from light originating outside the exterior shell.

The second layer of material is mechanically connected to a structure that supports the flexible material of the exterior shell.

The transportable theatre further may include an exterior lining covering an outside surface of the exterior shell.

The transportable theatre may further include a first structure configured to support the flexible material of the exterior shell, and a second structure configured to support the second layer of material, wherein the first structure and the second structure are mechanically independent of one another.

The second layer may include a flexible skin.

The exterior shell may include an inflatable structure that includes a plurality of inflatable tubes including inner and outer panels. The outer panels of the tubes may include an opaque layer and the inner panels of the tubes may correspond to the second layer of material.

The exterior shell may include an inflatable structure that includes a plurality of inflatable tubes including inner and outer panels. The inner panels may include an opaque layer, and the second layer is mechanically independent of the exterior shell.

A surface of the inflatable tube facing the first volume of space may include a non-reflective material.

The exterior shell may include an inflatable structure that includes a plurality of inflatable tubes including inner and outer panels. The inner panels may include an opaque layer, and the second layer may be mechanically independent of the exterior shell.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION

Figure 1A:
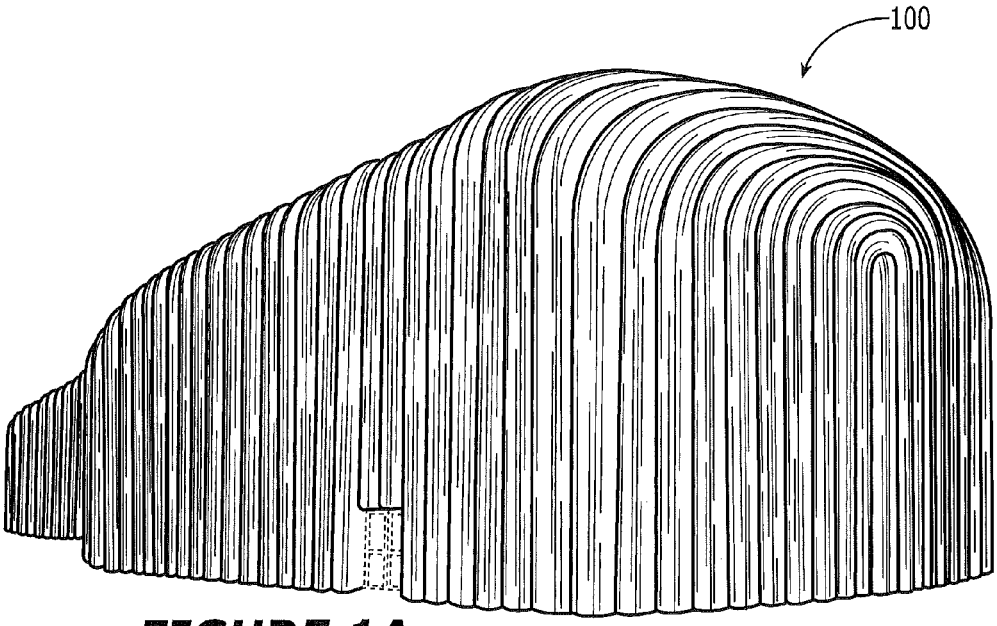
FIGS. 1A and 1B are perspective views of a transportable theatre structure according to some embodiments.
Figure 1B:
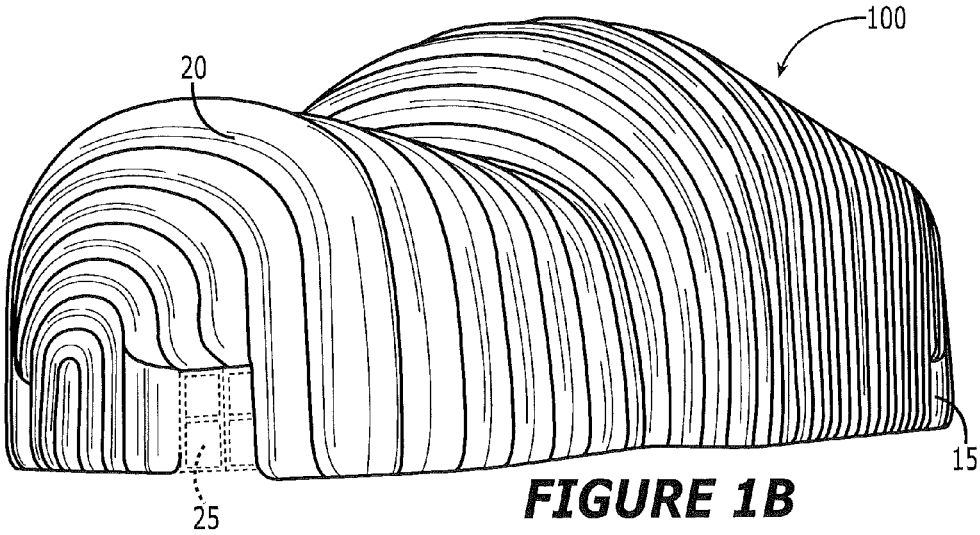
Figure 1C:
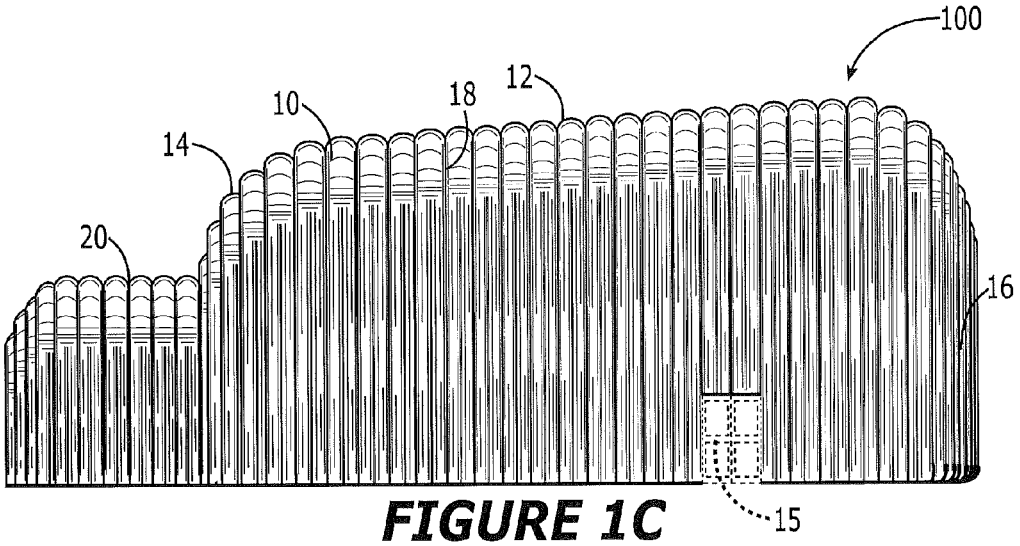
FIGS. 1C to 1F are a side elevation, top view, front elevation and rear elevation, respectively, of a transportable theatre structure according to some embodiments.
Figure 1D:
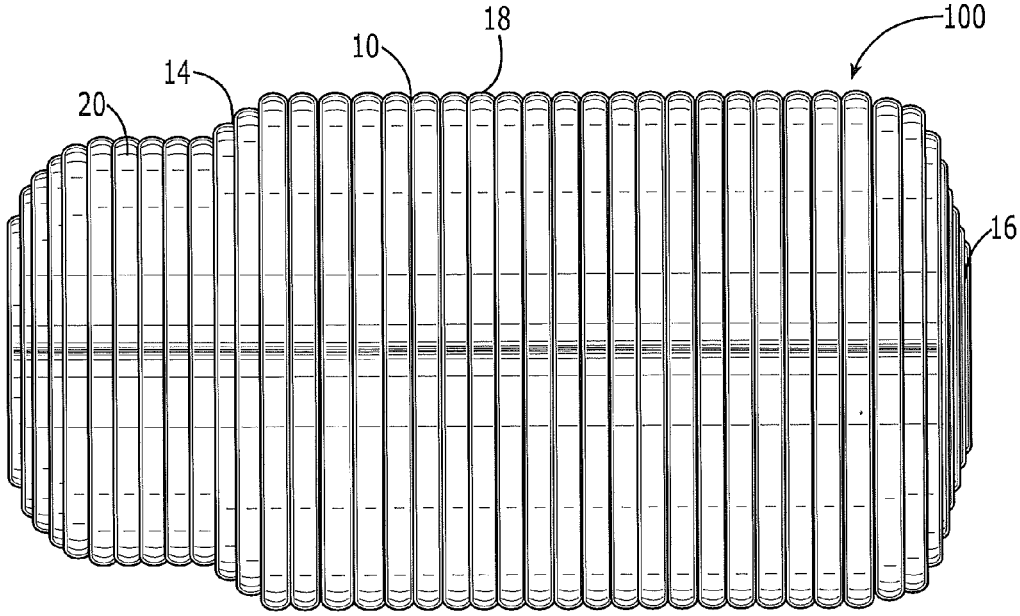
Figure 1E:
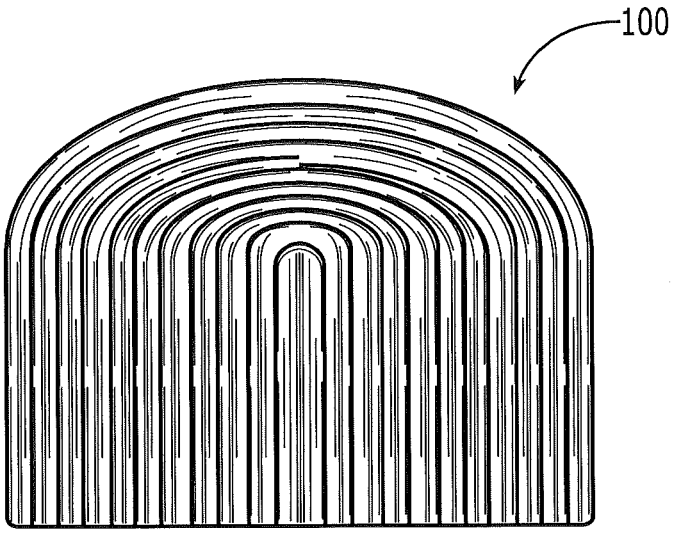
Figure 1F:
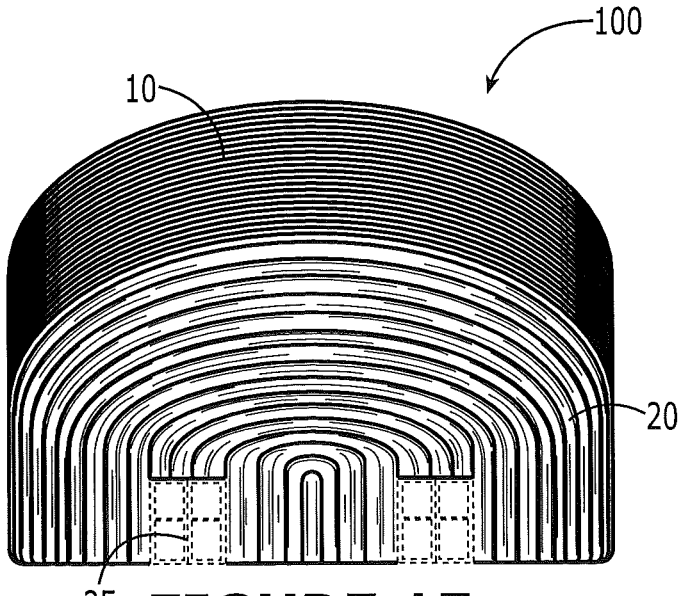

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

As described above, IMAX Corporation has pioneered the field of immersive motion picture display technology by combining a large screen, a larger image format, multi-channel immersive sound, and seats positioned so that the audience member has an unobstructed view of the screen with the screen sized to increase the field of view of the image on the screen viewed by audience member.

In many instances, it is desirable to exhibit a motion picture in a location that does not have an existing structure that can be converted or otherwise used for motion picture display, or where it is not desirable to build a dedicated structure for motion picture display. At the same time, it is desirable to provide the movie patron the same or similar type of experience they can obtain in a permanent theatre providing an immersive movie presentation. For example, it may be desirable to provide an immersive motion picture experience in areas that do not have sufficient infrastructure and/or the economic ability to support a large, permanent theatre structure. As another example, it is often desirable for exhibitors to have the ability to provide an immersive motion picture experience to patrons on a temporary basis, such as to attendees at a large gathering, an industry conference, a sporting event, etc., without building a permanent structure in which to display the motion picture.

In order to display a motion picture in a temporary location, some exhibitors have erected temporary outdoor screens on which to project a motion picture, or simply projected the motion picture on the side of an existing structure. It will be appreciated that it is not feasible to provide an immersive motion picture experience with an outdoor projection system. As will be appreciated, to provide a truly immersive motion picture viewing experience, it is highly desirable for the motion picture to be displayed within a building structure that can shield the audience from external sounds and light and provide controlled acoustics for improved sound quality. Building a temporary or semi-permanent non-transportable structure to display the motion picture presents its own set of challenges, however, due to the time and expense to construct the building, and potentially the expense of demolishing or otherwise removing the building when it is no longer needed.

Accordingly, some embodiments of the present invention provide a transportable theatre that can be relatively easily, quickly, and economically assembled, disassembled and/or transported, but that is capable of providing an immersive motion picture experience, such as a motion picture experience that is presented in a manner that is qualitatively superior in terms of the projected image quality, field of view, and/or audio experience relative to conventional outdoor or temporary theatres.

Some embodiments may further provide a transportable theatre that can be assembled, disassembled and/or transported without significantly damaging either the sensitive audiovisual equipment used to display a motion picture, the structure of the transportable theatre itself, and/or the surroundings in which the transportable theatre is erected. Moreover, some embodiments may provide a transportable theatre that can be used to provide an immersive motion picture experience in the daytime or night time without unduly disrupting activities outside the theatre due to the generation of excessive sound or light outside the theatre enclosure, and/or without sound or light generated outside the theatre enclosure interrupting or distracting from the immersive motion picture experience within the theatre.

Still further embodiments provide a transportable motion picture theatre that has controlled internal acoustic characteristics so as to provide a truly immersive motion picture viewing experience to viewers within the theatre and/or to reduce noise that may otherwise interfere with the viewing experience. The quality of the presentation may be improved for the audience by providing a multi-speaker sound system with loudspeakers strategically placed within the theatre. Acoustic panels or other materials may be provided within the theatre enclosure and may be positioned in such a manner as to provide directional sound control within the enclosure by absorbing and/or redirecting sound within the enclosure. For example, the sound generated by the multi-speaker sound system may be absorbed by the acoustic panels and/or directed by the acoustic panels away from the sidewalls and/or roof of the theatre structure, so that unwanted reflections may be reduced and sound quality perceived by the audience members may be improved, while the level of sound emanating from inside the theatre enclosure to the surrounding area may be reduced.

Embodiments of the present invention are described herein with respect to a transportable structure that includes one or more inflatable sections. However, it will be appreciated that the invention is not limited to inflatable structures, but rather could be implemented using non-inflatable structures.

In some embodiments, the main theatre section may include a pair of opposing sidewalls, a pair of opposing end walls and a roof that cooperatively define an interior theatre space that is customized for a heightened motion picture viewing experience.

In some embodiments, the sidewalls, end walls and roof may be provided by a plurality of elongated inflatable beams each including a plurality of elongated panels joined along longitudinal edges thereof and defining a sealed leaktight compartment into which pressurized fluid may be pumped to cause the beam to inflate. The inflatable beams may be joined side by side along adjacent edges to form the main theatre structure including the sidewalls, end walls and roof.

To assist in supporting the substantial weight of a theatre-sized enclosure, an inflatable beam may include a plurality of integral support ribs at various locations along the length of the beam. The integral support ribs may be provided on the interior and/or exterior of the beam.

In some embodiments, the main theatre section may include a first entrance/exit passageway in one of the end walls and a second entrance/exit passageway in one of the sidewalls. Additional entrance/exit passageways may also be provided in various ones of the sidewalls and end walls. Attachment points may be provided adjacent both the first and second entrance passages to facilitate connection of an antechamber, such as an entrance/exit vestibule or lobby, that is external to the main theatre section over the first and/or second entrance passage. In some embodiments, the external chamber, or antechamber, may be formed of inflatable beams as described above and/or may include solid panel construction.

Still further embodiments of the invention provide a transportable motion picture theatre including a main theatre section having a substantial geographic footprint, e.g., greater than about 6000 square feet, and in some embodiments, greater than about 7000 square feet, in some embodiments greater than 8000 square feet. Some embodiments may have a large internal volume, e.g., greater than about 300,000 cubic feet, and at least one external chamber that is removably attachable to a plurality of sites on the main theatre section. A structure according to some embodiments can accommodate more than 100 patrons, and in some cases can accommodate more than 300 patrons. In some embodiments, up to 500 or more patrons can be accommodated in a seating structure within the main theatre structure, the seating structure having a steeply raked configuration that provides enhanced viewing of a motion picture screen for a more immersive motion picture experience. Without a seating structure, the structure could accommodate 800 patrons or more. Other seating configurations are contemplated within the scope of the present invention, including configurations in which at least a portion of the audience is standing.

In some embodiments, the structure can accommodate a motion picture viewing screen of at least about 30 to 60 feet high and about 50 to 80 feet wide with a viewing audience of greater than 100 patrons, and in some embodiments greater than 300 patrons, and in further embodiments significantly greater than 300 patrons. However, a theatre according to some embodiments may be sized to accommodate a smaller number of patrons. Furthermore, as will be described in more detail below, the interior volume of the structure can be reconfigured to accommodate fewer patrons if desired by partitioning the interior of the structure.

In some embodiments, the main theatre section includes a plurality of entrance passages therethrough with attachment points configured to receive corresponding attachment members of the external chamber located adjacent respective ones of the plurality of entrance passages. The external antechamber may itself include one or more entrance passages, and may be configured as an entrance/exit vestibule, a lobby, a private viewing room, a merchandise store, or other type of facility.

A transportable theatre structure according to some particular embodiments includes a demountable building including five structures which are joined together to serve as a mobile venue with an external footprint that can measure approximately 13,000 square feet. The theatre structure may be air-inflated and may include cylindrical pressurized tubes of a stitched and welded construction. The nature of the construction results in a virtually airtight structure with high rigidity which may require less power to pressurize than other forms of air-supported structures.

Entry to the inside of the structure may be made via one or more door entrances/exits designed into the external wall of the structure. Some embodiments include additional doors feeding into the main theatre space from an attached lobby.

Light-weight load patches may be provided in the roof and walls of the building from which banners, lininging, acoustic treatment panels, and other items may be suspended.

Additional features and embodiments of the present invention will be described in more detail below with reference to the drawings.

Theatre Shape and Structure

Figure 2A:
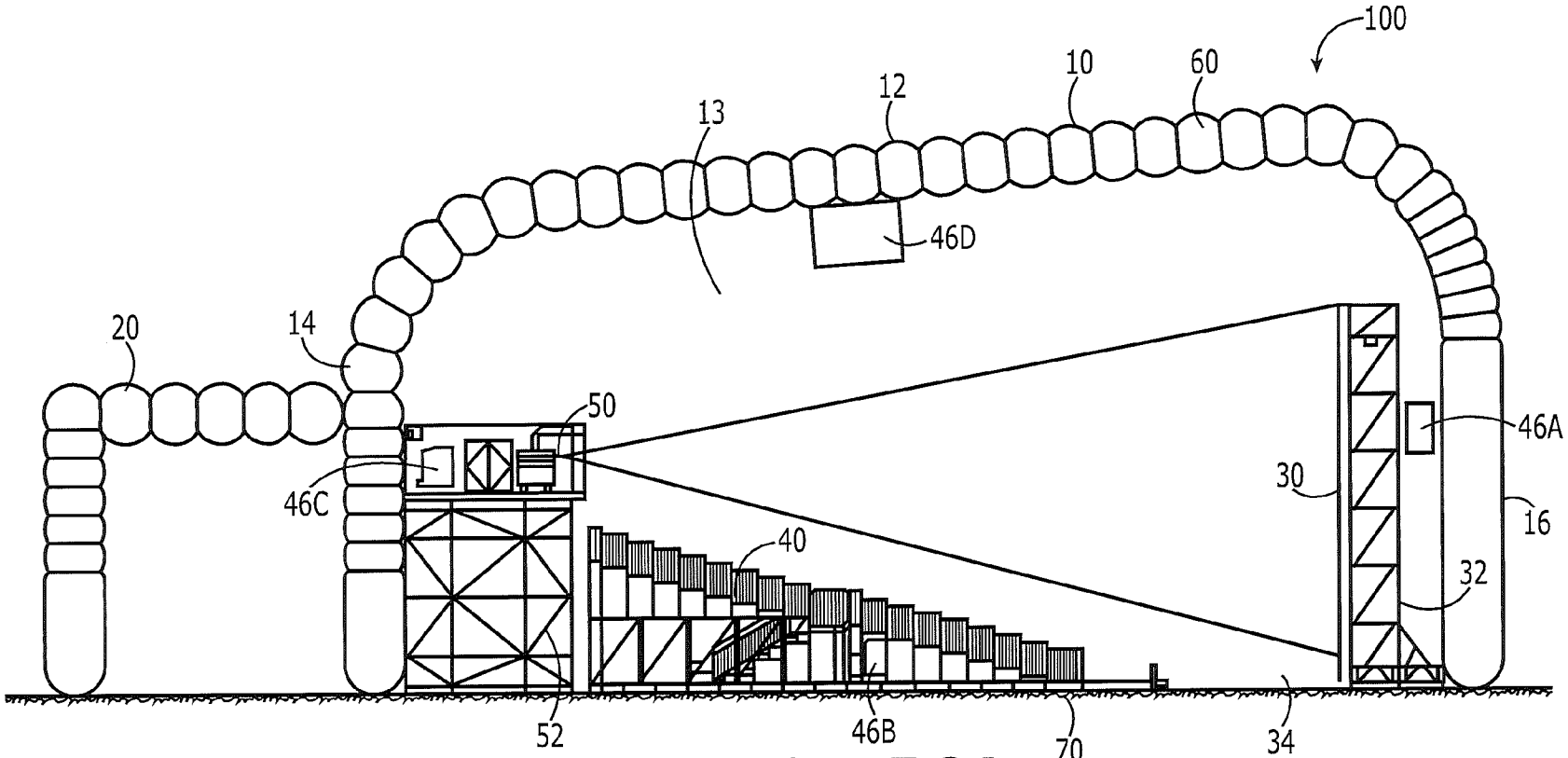
FIG. 2A is a sectional elevation view of a transportable theatre structure according to some embodiments.
Figure 2B:
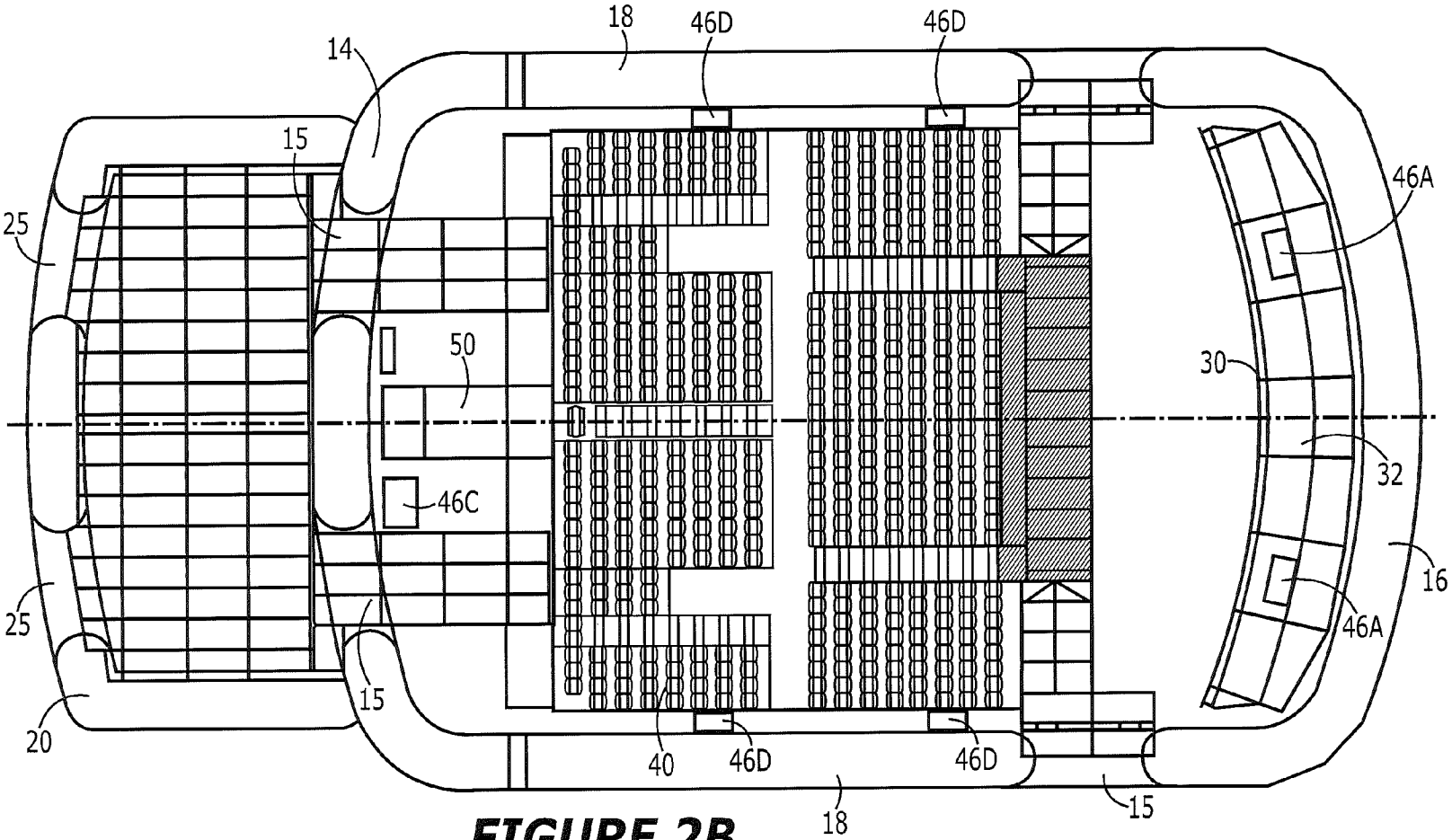
FIG. 2B illustrates a plan layout of a transportable theatre structure according to some embodiments.

Referring to FIGS. 1A to 1F and 2A to 2D, a transportable theatre structure 100 according to some embodiments is illustrated. FIGS. 1A to 1F provide various views of a theatre structure 100 according to some embodiments, including perspective, elevation, plan and cross sectional views. FIG. 2A is a sectional elevation, and FIG. 2B shows a plan layout of a theatre structure 100 according to some embodiments. For ease of explanation, the structure 100 is referred to herein as a theatre structure. However, although the structure 100 may be particularly suitable as a venue for motion picture exhibitions, the structure 100 can also be used for many other events, such as live broadcasts, theatrical presentations, trade shows, conferences, sporting events, and other events typically hosted in stadiums, athletic facilities, leisure parks, conference centers, etc.

Furthermore, although referred to herein as transportable, it will be appreciated that a theatre structure according to some embodiments could be installed or otherwise intended for use on a permanent or semi-permanent basis.

The theatre structure 100 includes an inflatable main theatre section 10 including a pair of opposing sidewalls 18, first and second endwalls 14, 16, and a roof 12 that cooperatively define an interior theatre space 13. The interior theatre space 13 is sized to hold a movie screen 30 and associated screen support structure 32 having dimensions of at least about 30 feet high by 60 feet wide, and in some cases about 60 feet high by 80 feet wide. However, smaller screens are contemplated in some embodiments. The interior theatre space 13 is further configured to hold a seating section 40, a projection system 50, and an associated audio system. In some embodiments, the main theatre section 10 may have interior dimensions of about 75 feet wide (from sidewall 18 to sidewall 18) and about 115 feet long (from first end wall 14 to second end wall 16).

Figure 2C:
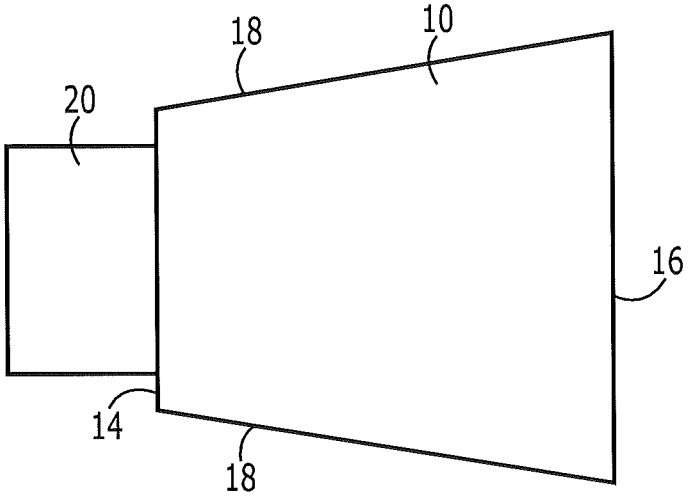
FIGS. 2C and 2D illustrate alternate exemplary plan views of transportable theatres structure according to some embodiments.
Figure 2D:
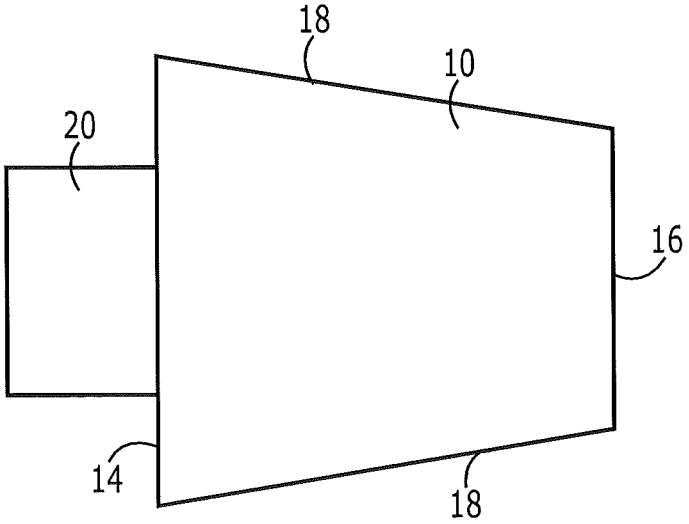

The sidewalls 18 may be generally parallel to one another, as illustrated in FIG. 2B. However, in some embodiments, as illustrated in FIGS. 2C and 2D, the sidewalls 18 may taper towards or away from one another from the first end wall 14 to the second end wall 16, so that the width of the main theatre section 10 at the first end wall 14 is narrower than the width of the main theatre section 10 at the second end wall 16 (i.e., the sidewalls 18 taper out away from the first end wall 14), or, in other embodiments the width of the main theatre section 10 at the first end wall 14 is greater than the width of the main theatre section 10 at the second end wall 16 (i.e., the sidewalls 18 taper in from the first end wall 14 to the second end wall 16). Tapering the sidewalls 18 may affect the acoustic characteristics of the theatre structure 100 by altering the reflection of sound within the interior volume of the structure. In particular, because the tapered sidewalls are not parallel to one another, acoustical reflections from one sidewall to another may be reduced. Tapering of the sidewalls may also be used to enhance the visual presentation of a motion picture. For example, having the sidewalls taper outward from the rear of the theatre near the first end wall 14 to the front of the theatre near the second end wall 16 as shown in FIG. 2C may provide a more immersive motion picture viewing experience.

A transportable structure according to some embodiments can be configured in many different ways to provide the flexibility to provide different venues depending upon the desired application. For example, a short run theatre (i.e., a transportable theatre in town for only a few days) may not include the seating section and could be a smaller structure. Whereas, a larger theatre with full seating section and customized for a large theatre audience can be installed for longer runs.

Figure 2E:
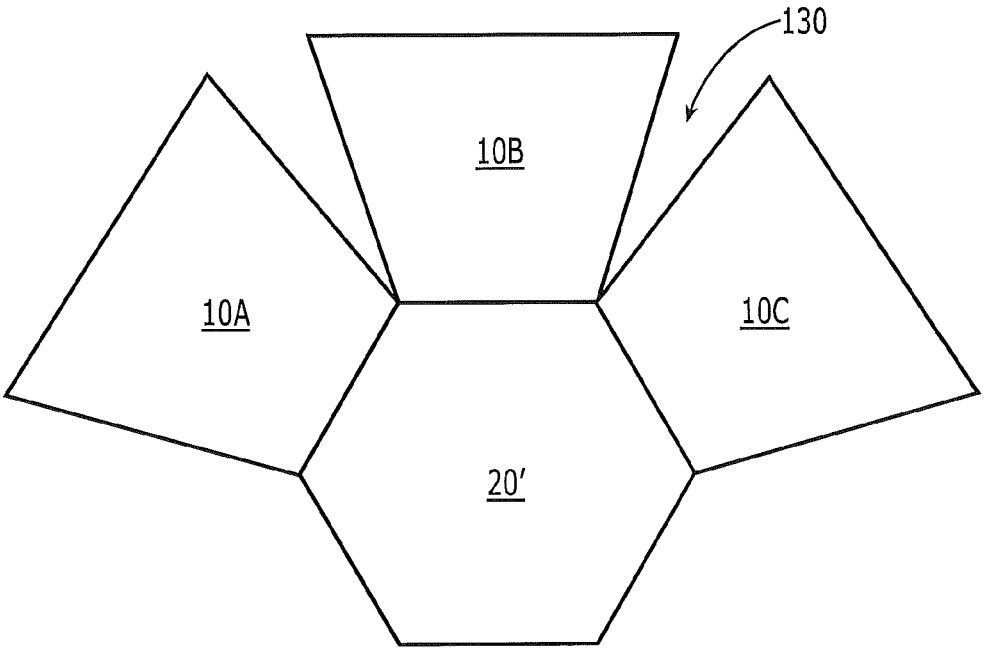
FIG. 2E illustrates a configuration of a transportable theatre structure according to some embodiments including a central lobby structure and a plurality of attached theatre structures.

A transportable theatre according to some embodiments can be modular to provide for customized designs. For example, referring to FIG. 2E, a modular theatre 100' may allow for multiplex type theatre where different movies are shown in different theatres. A modular theatre 130 may be provided, for example, by providing a plurality of main theatre sections 10A, 10B, 10C and joining the main theatre sections together with a lobby section 20' using the techniques described herein. In some embodiments, the lobby can be of a generally circular shape with distinct theatre portions attached around the lobby and extending out form the lobby. In some embodiments as shown, for example, in FIG. 2E, the lobby can have a generally polygonal shape. In this manner, the multiplex theatre can be quickly constructed to provide alternative movies for the public. Various structural inflatable units can be joined to other structural units to create individual theatre rooms in accordance with the embodiments described herein.

Referring again to FIG. 2A, the roof 12 of the structure 100 may be slanted from the first end wall 14 to the second end wall 16. As shown in FIG. 2A, in some embodiments, the roof 12 of the structure 100 may be slanted upwards from the first end wall 14 to the second end wall 16. In some embodiments, the roof 12 of the structure 100 may be slanted upwards from the first end wall 14 to the second end wall 16 at an angle of about 5 degrees, so that the main theatre section 10 has an interior height that varies from about 40 feet near the first end wall 14 to about 60 feet near the second end wall 16. As with the tapered sidewalls, slanting the roof may improve the acoustic characteristics of the structure. In particular, because the floor and ceiling are not parallel to one another, acoustical reflections from the floor to the ceiling may be reduced.

A plurality of entrance/exit passageways 15 provide access to the main theatre section 10. Referring again to FIG. 2A, in some embodiments, the sidewalls, end walls and roof may all be provided by a plurality of inflatable beams, or tubes, 60. Each of the beams 60 may include a plurality of panels joined along longitudinal edges thereof and defining a leaktight interior compartment into which pressurized fluid, such as pressurized air, may be pumped to cause the beam 60 to inflate and become relatively rigid. The inflatable beams 60 may be joined side-by-side along adjacent edges to form the main theatre section 10 including the sidewalls 18, end walls 14, 16, and roof 12.

To give the inflatable beams 60 a desired shape and/or to enhance their rigidity, the beams 60 may be provided with internal gussets, or inserts, at various locations within the beams. The gussets may be provided, for example, at points within the beam where the beam has a curvature. The gussets may be formed of a flexible material, and in some embodiments may be vinyl inserts.

In previous inflatable structures, the sidewalls having the longest dimension are typically curved from the base of the structure up to the center of the structure, and form an arc shape from one side of the structure to the other. As shown in FIGS. 1A to 1F, portions of the sidewalls 18 of the transportable theatre structure 100 may be vertical or substantially vertical relative to the surface on which the theatre structure 100 is erected. In addition to improving the aesthetic appearance of the structure, vertical sidewalls may provide functional advantages for a structure used for motion picture exhibition. For example, the vertical sidewalls permit the installation of a larger rectangular screen than would be possible for a given volume of the structure with curved sidewalls.

The seating arrangement inside the theatre may have a substantial impact on the visual presentation to the audience, particularly when an immersive motion picture viewing experience is desired. Thus, it may be desirable for the theatre not to have any audience seats that are outside the width of the screen, so that the screen increases the field of view of each member of the audience. Thus, if the sidewalls of the structure were curved (arcuate), there may be a substantial amount of unused space in the theatre structure adjacent the walls. That is, the edge of a rectangular screen should be placed far enough from the edge of the structure where the sidewall meets the ground that there is sufficient overhead room to accommodate the height of the screen. Having curved sidewalls as opposed to vertical sidewalls would require the edge of the screen to be placed farther from the edge of the structure, potentially resulting in unused space from the edge of the screen to the edge of the structure.

It will be appreciated that embodiments of the invention are not limited to structures having vertical or substantially vertical sidewalls 18. Furthermore, embodiments of the invention, as illustrated in FIGS. 1A to 1F and 2A, may have some curvature at the corners thereof due to the curvature of the inflated beams 60 themselves and/or curvature induced in the structure by the manner in which the beams 60 are attached to one another, particularly near the front and back upper corners of the structure 100 (i.e., the corners formed at the intersection of the roof 12 with the first and second end walls 14, 16, respectively). Moreover, some amount of curvature of the beams 60 and/or the structure itself may be desirable for structural support, as sharp corners may be structurally weak and/or may lead to unwanted sagging of the roof.

Having substantially vertical sidewalls may also create the perception to the human eye that the screen 30 inside the theatre appears larger.

As shown in FIGS. 1 and 2A, the beams 60 may connect to a base 70 on one side as a portion of the first sidewall 18 and continue over the top to form a portion of the roof 12, down the other side to form a portion of the second sidewall 18, and connect to the base 70 on the other side. The beams 60 may be connected in a side-by-side arrangement along the length of the beams. In some embodiments, at least some of the beams 60 may be attached together along their respective lengths.

The beams 60 can connect to one or more air ducts integrally or releasably for inflation and deflation of the tubes by the use of valves and/or manifolds, as described in more detail below. The valves control the sequence in which the tubes inflate and deflate. The valves may be any known type of valve for controlling the sequence of fluid communication with a pressurized fluid source, e.g. air or nitrogen gas. In addition, check valves and pressure sensors may be placed in the inflation line to reduce overinflation and/or leakage. One or more air compressors, pumps or fans are connectable to the valves for inflating the beams, and air compressors/pumps/fans may be connected to vacuum ends of the valves for deflating or evacuating the beams 60.

Figure 3A:
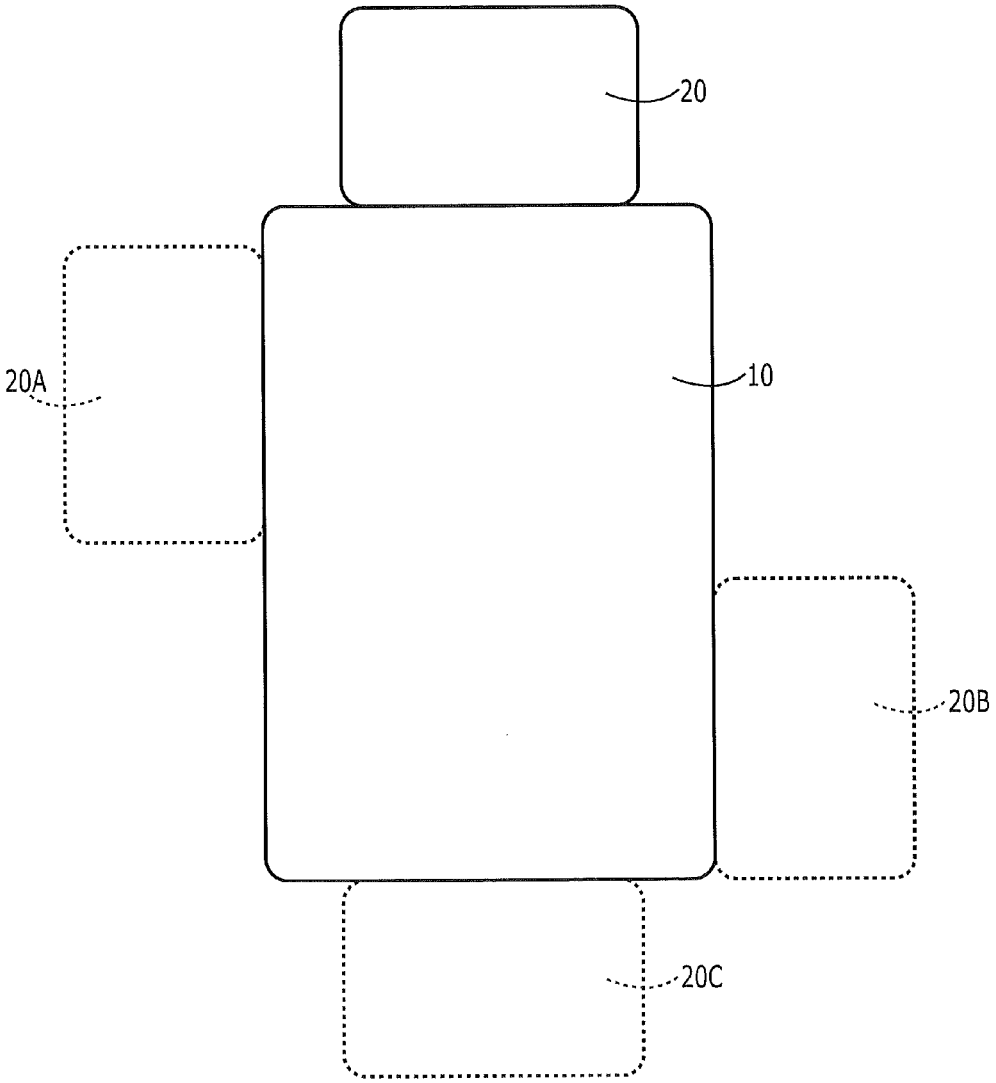
FIG. 3A is a plan layout of alternate antechamber configurations for a transportable theatre structure according to some embodiments.

Referring to FIGS. 2A and 2B, an external chamber 20 may be attached to the main theatre section 10. The external chamber 20 may function as a lobby, an entrance/exit vestibule, a private viewing chamber, a gift shop, a merchandise shop, a food store, or any other function. The external chamber 20 may be releasably attached to the outside of the main theatre section 10 and an interior portion of the external chamber 20 may communicate with the interior portion of the main theatre section through one or more of the passageways 15 (FIG. 3A).

The external chamber 20 can have any desired shape/size and can be formed using inflatable beam construction as described above and/or using non-inflatable panel construction. In particular embodiments, the external chamber 20 may have a width that is less than or equal to the width of the side or end of the main theatre chamber 10 to which is attached, and may have a height less than or equal to the height of the side or end of the main theatre chamber 10 to which is attached. In some embodiments, the external chamber 20 may have a height and/or width that is greater than a corresponding dimension of the main theatre chamber 10.

The external chamber 20 can be releasably attached to the main theatre section 10 or can be integral thereto. In embodiments in which the external chamber 20 is releasably attachable to the main theatre chamber 10, attachment may be made using seamless joints. Such an attachment may provide a leaktight seal between the main theatre chamber 10 and the external chamber 20, thereby reducing leakage of rainwater into the external chamber 20 through the joint between the external chamber 20 and the main theatre chamber 10.

Connection points, joints, and/or fasteners may be provided on the exterior of the main theatre chamber 10 where it may be desirable to connect the external chamber 20. Thus, in some embodiments, it is possible to connect one or more external chambers 20 at various locations on the main theatre chamber 10.

In the embodiments illustrated in FIGS. 2A and 2B, the external chamber 20 is connected to the main theatre chamber 10 on the outside of the first end wall 14 and extends longitudinally away from the end wall 14 of the main theatre chamber 10. The external chamber 20 can thereby serve as a convenient entranceway and/or lobby to the main theatre section 10. However, the length of the overall structure 100 is extended by the width of the external chamber 20. For example, in some embodiments, the overall length of the structure 100 including the external chamber 20 may be in excess of 150 feet, which may exceed the available space for the structure 100.

According to some embodiments, one or more external chambers 20 can be attached at different locations around the exterior of the main theatre chamber 10, as illustrated, for example in FIG. 3A. As shown therein, an external chamber 20 may be attached at one end of the main theatre chamber 10. However the external chamber 20 can also be attached to the main theatre chamber 10 at other locations, such as on side locations 20A, 20B of the main theatre chamber 10 or at an opposite end location 20C. It will also be appreciated that more than one external chambers 20, 20A, 20B, 20C may be provided in some embodiments.

Figure 3B:
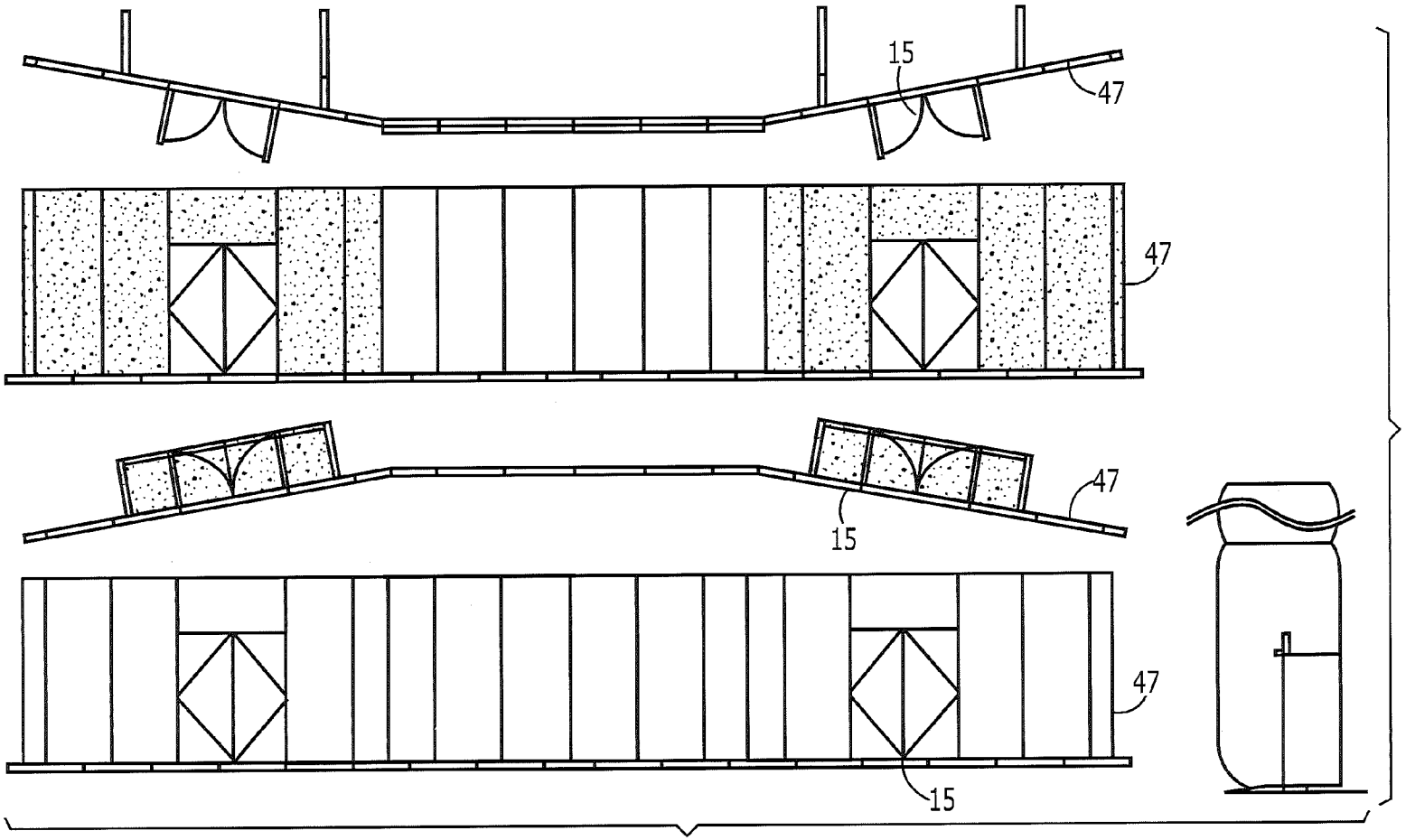
FIG. 3B illustrates a double door entrance attached to a transportable façade for a transportable theatre structure according to some embodiments.

The entrance/exit passageways 15 may be sized such that a double door entrance attached to a transportable façade 47 as illustrated in FIG. 3B may be installed therein.

Attachment means may be provided on the exteriors of the sidewalls 18 so that the interior of the external chamber 20 communicates with the interior of the main theatre section 20 through a passageway 15 in one of the sidewalls 18. It will be appreciated, however, that an external chamber 20 need not communicate with the interior of the main theatre section. For example, one external chamber may be attached so as to communicate with the interior of the main theatre section 10 and may thereby function as an entrance/exit vestibule or lobby, while another external chamber 20 may be attached to a location on the outside of the main theatre chamber that does not include a passageway 15 so that the external chamber does not communicate with the interior of the main theatre chamber 10. The second external chamber 20 may be used, for example, for ticket sales, promotional sales, advertising, or any other suitable purpose.

Referring again to the embodiments of FIGS. 2A and 2B, the external chamber 20 may be a lobby into which patrons of the theatre can enter via one or more passageways 25 (FIG. 2B) into the external chamber 20. Doors may be removably installed in one or both of the passageways 25. The patrons may then enter the main theatre chamber 10 through passageways 15 connecting the main theatre chamber 10 to the lobby/external chamber 20. The removable doors may include modular door frames having, for example, painted wood sidewalls and roofs.

Theatre structures according to the present invention are not limited to the particular shapes/structures illustrated in the figures. Other shapes may be possible for the transportable structure, and may provide acceptable or even improved levels of acoustic and visual experience. For example, some other shapes that may be possible for the overall structure include a wedge shape in which the sidewalls of the structure taper sharply inward or outward, and/or or an amphitheater shape in which the seating arrangement is provided with a generally arcuate circumference.

Exit doors may be provided by the passageways 15 on opposite sides of the theatre structure 100. Additional exits can be provided in the sidewalls or end walls of the structure 100.

Figure 4A:
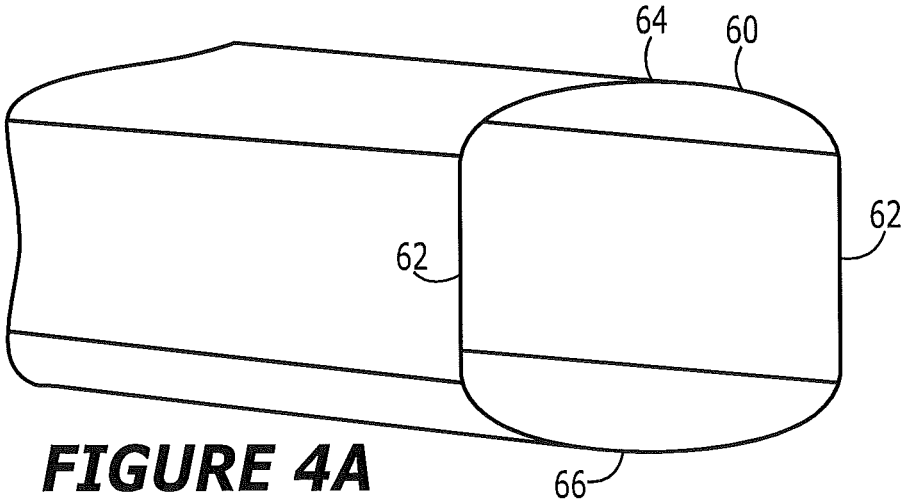
FIG. 4A is a sectional perspective illustration of an inflatable beam used in a transportable theatre structure according to some embodiments.
Figure 4B:
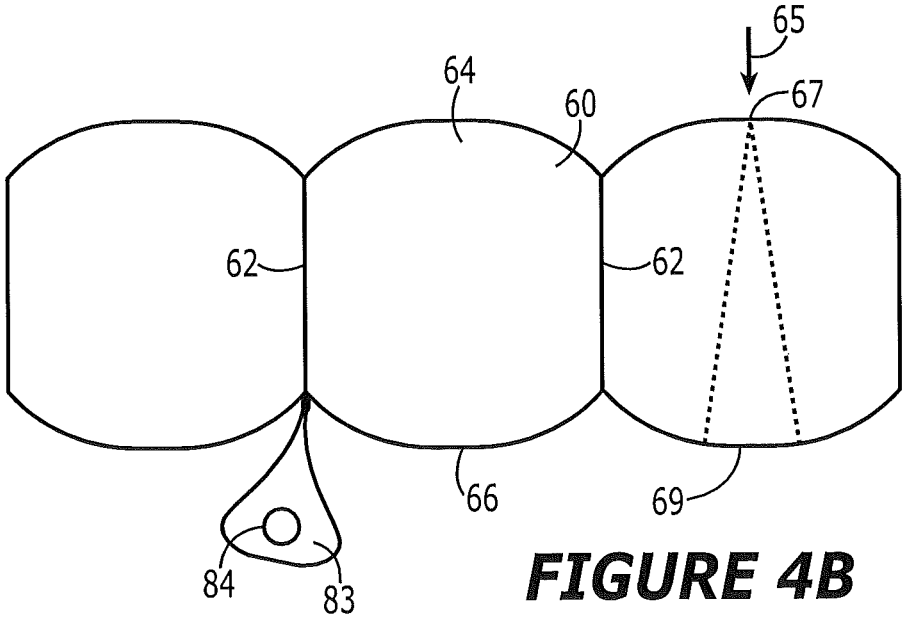
FIG. 4B is a partial cross sectional view of a portion of a transportable theatre structure taken along line A-A' in FIG. 4A according to some embodiments.
Figure 4C:
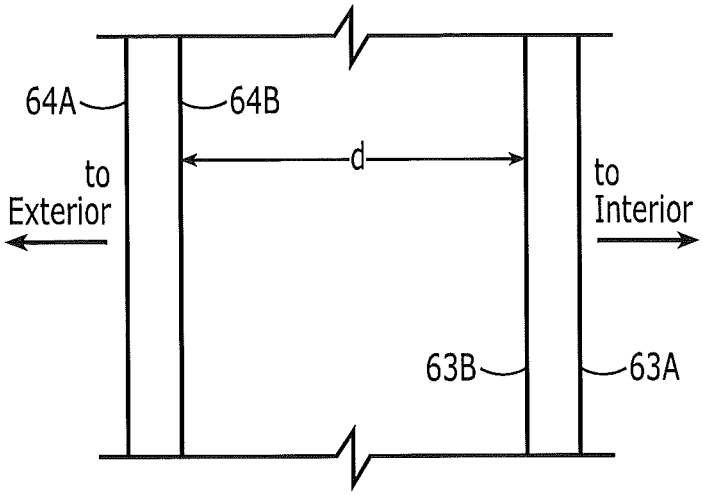
FIG. 4C is a partial side view of an inflatable beam of a transportable theatre structure according to some embodiments.

Reference is now made to FIGS. 4A to 4C, which illustrate aspects of the inflatable beams 60 in more detail. As noted above, the transportable theatre structure 100 may be made from a plurality of inflatable tubes or beams 60. In some embodiments, each tube or beam is formed as a continuous envelope to promote leak tightness of the volume of area which it confines within the walls of the tube. Acoustic materials, including coatings, sheeting, cloth, etc., can be applied to one or more inner or outer surfaces of the panels that form the beams 60 to reflect/absorb incident sound. However, applying such materials can make it difficult to deflate and collapse the structure.

Referring to FIG. 4A, a beam 60 can include an outer panel 64 and an inner panel 66, and at least one side panel 62 connecting the outer panel 64 and the inner panel 66 along their opposed sides. In some embodiments, two side panels 62 may be provided and may connect the outer and inner panels 64, 66 along opposite edges thereof. The panels 62, 64, 66 may be stitched together along the length of the beam 60.

In other embodiments, the beam 60 may include a single panel that is sealed along its long edges.

The beams 60 can be made of a suitable material, such as polyester-type or polyamide type synthetic resinous yarns, vinyl, or other similar strong and flexible material. In some embodiments, the panels may include three layers: an outer vinyl layer, a middle opaque vinyl layer, and an inner vinyl layer. One or both sides of the panels can be coated with a thermoplastic resin, such as polyurethane, in order to enhance water-resistance.

The beams 60 can be sealed at opposing ends thereof to form a sealed volume between the panels into which a fluid, such as air can be pumped. The beams 60 can be sealed using a separate sealing panel (not shown) that is sewn or otherwise fastened in a leaktight manner to the ends of the panels, or by sewing the panels together at their ends, or by attaching or fastening the panels at their ends by any other suitable means.

It may be important to tightly control light within the main theatre section 10. Accordingly, the material of the beams may be nontranslucent or opaque in order to both block out light and not reflect light. In one embodiment, if the material itself is translucent, then the material can be coated with a polymer paint to achieve the nontranslucent state for the inflatable structure. In some embodiments as discussed below, a lining or other covering may be provided over inner and/or outer surfaces of the walls to assist in blocking light.

The outer surface of the structure 100 can be white to reflect the sun light away and/or reduce heat build up on and within the structure 100.

In some embodiments, the inner, outer and/or side panels of the beams 60 can be made of or include an opaque material to block exterior light from entering the theatre. Alternatively, the panels can be coated with a dark coating or material that will block light, and/or a reflective material that reflects light. In some embodiments, the outside of the outer panel 64 may be coated with a reflective material to reduce absorption of light (and thereby reduce absorption of heat) by the structure, while the side of the inner panel 66 that faces the interior of the theatre structure 100 may be coated with a dark or non-reflective material to reduce reflection of light from the motion picture screen, thereby reducing visual distractions to the audience within the structure.

Referring to FIG. 4B, small holes ("pinholes") may exist in the outer panel 64 of a beam 60 and/or may develop through assembly/disassembly of the structure. A pinhole may act as a miniature optical lens and direct light onto a larger spot on the inner layer of the beam 50. For example, as shown in FIG. 4B, light 65 incident on an outer panel 64 of a beam 60 can enter through a small pinhole 67 in the outer panel 64 and be imaged as a spot 69 on an inner surface of the inner panel 66 of the beam 60. The spot 69 may be visible from inside the structure 100.

Accordingly, referring to FIG. 4C, the exterior structure may include inflatable beams 60 having a first outer layer 64A that is configured to reflect light and a second outer layer 64B, under the first outer layer 64A, that is opaque to light on an outside of the beam 60 (i.e., facing away from the structure 100). The first outer layer 64A can be white to reflect sun light away and reduce any heat build up on and within the structure 100. A first inner layer 66A that is light absorbing (i.e. non-transparent and non-reflective) and a second inner layer 66B that is opaque to light are provided on an opposite side of the beam 60 facing the interior volume of the structure 100. The outer layers 64A, 64B are spaced apart from the inner layers 66A, 66B by the cross sectional width of the inflatable beam, represented by a distance d. Thus, light that is imaged onto the inner panel 66 may not be visible inside the structure 100.

Linings

Figure 5:
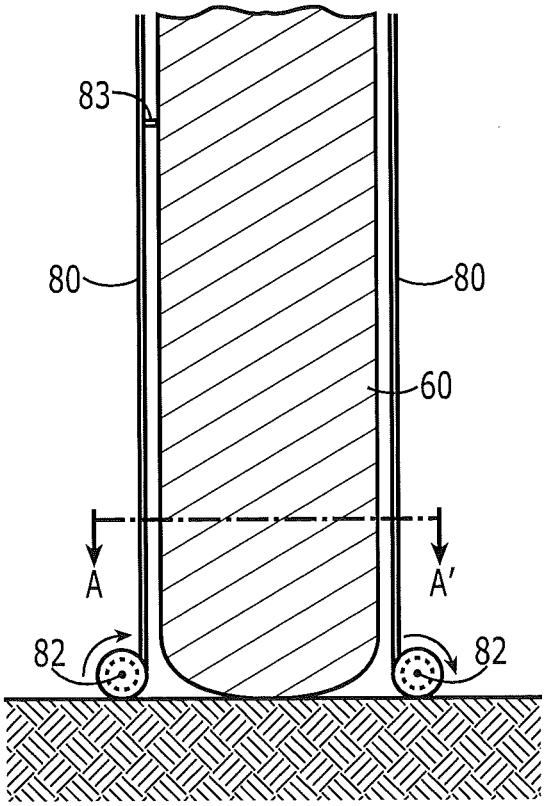
FIG. 5 is a partial side view of an inflatable beam of a transportable theatre structure with inner and outer linings according to some embodiments.

Referring to FIG. 5, the interior and/or exterior of the structure or portions thereof may be covered by a lining 80, which may be rolled/unrolled from dispensers 82. The leading edge of the lining 80 can be pulled and attached to the inner or outer surfaces of the structure 100 at light weight load patches that provide pickup members 83 thereon. In some embodiments, the lining 80 may be pulled from the base 70 of the structure 100 on one side all the way to the base 70 of the other side of the structure 100. The lining 80 can be attached to the theatre structure 100 or non-inflatable structures by the pickup members 83 shown in FIG. 5 or in any conventional way known in the art. For example, the inner and outer linings 80 may be releasably attached to the base of the beams 60 around the interior and exterior of the theatre structure 100. Alternatively, the inner and outer linings 80 could be permanently attached to the beams 60. Various forms of releasable fastener means may be employed for securing the linings 80 to the beams 60. In addition, inflatable columns, poles or other features may also be incorporated on the exterior of the theatre structure 100 giving options for dramatic aesthetic or structural appearances.

One type of lining 80 for use in the interior space of the transportable theatre is scrim. Scrim is a finely woven lightweight fabric frequently used in theatrical venues. Flat black scrim can be hung from the ceiling along the sidewalls and ceiling to give the illusion of a more solid and/or uniform looking wall and ceiling. The scrim may also reduce reflections of light and/or sound from the interior surfaces of the inflatable beams.

To achieve a more immersive motion picture viewing experience, the dimensions of the structure 100 may be tied to the screen 30 and the desired height, width and aspect ratio thereof. This can be done by either defining the width of the structure 100 from sidewall to sidewall to accord with the desired aspect ratio. In some embodiments, the lining 80 can be hung in such a manner from the ceiling and/or side/end walls to effectively change the width of the viewing area to match the desired aspect ratio, and/or to reconfigure the interior volume of the structure to match the size/shape of the screen. That is, the scrim may be used to enclose the volume of the seating area to more closely match the dimensions of the screen.

The material of the scrim may be selected such that it allows sound to easily pass through it, allowing loudspeakers to be positioned behind the scrim. Alternatively, the material of the scrim may be made to be sound insulating (e.g. sound absorbing or dampening).

An advantage of the scrim is that the interior of the theatre can be reshaped without structural changes to the theatre structure 100. The reshaping can be done for functional and/or aesthetic reasons. With respect to the former, repositioning the scrim makes it possible to define a different interior space better suited for another projected image aspect ratio, for example. For example, if the inflatable structure 100 has curved walls, the scrim can be hung vertically to redefine the interior shape of the theatre to provide a more immersive experience. In addition, the scrim may hide sound panels, and/or anything else along the theatre wall structure or ceiling.

The scrim can be attached to interior walls using the pickup members 83 shown in FIG. 4B. The pickup members 83 can be used to hold the scrim. The pickup members 83 may include a vinyl material containing a hole 84 therethrough to permit connection thereto. A cable clamp may be used to attach the scrim or other elements to the structure. A cable clamp (not shown in the figures) may provide for a quick release and strong connection between the scrim/speaker/panel and the pickup member 83. The pickup members 83 can be stitched into flaps on the surface of the beams 60. Other means of attaching the pickup members 83 are also possible. The pickup members 83 can be placed on the sidewalls and/or ceilings of the structure.

Figure 6A:
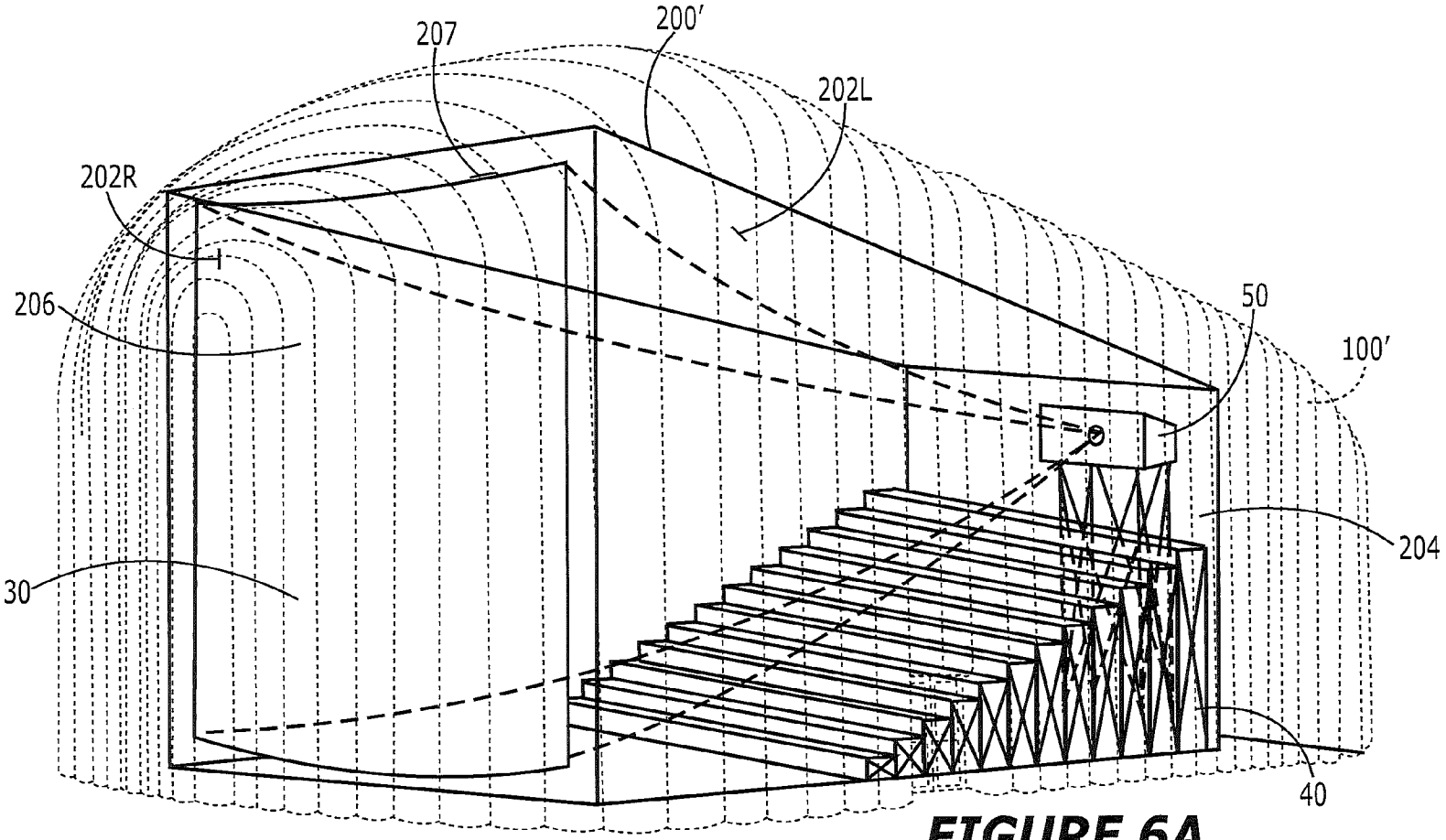
FIGS. 6A, 6B, and 6C illustrate configurations of transportable theatre structures in accordance with some embodiments.
Figure 6B:
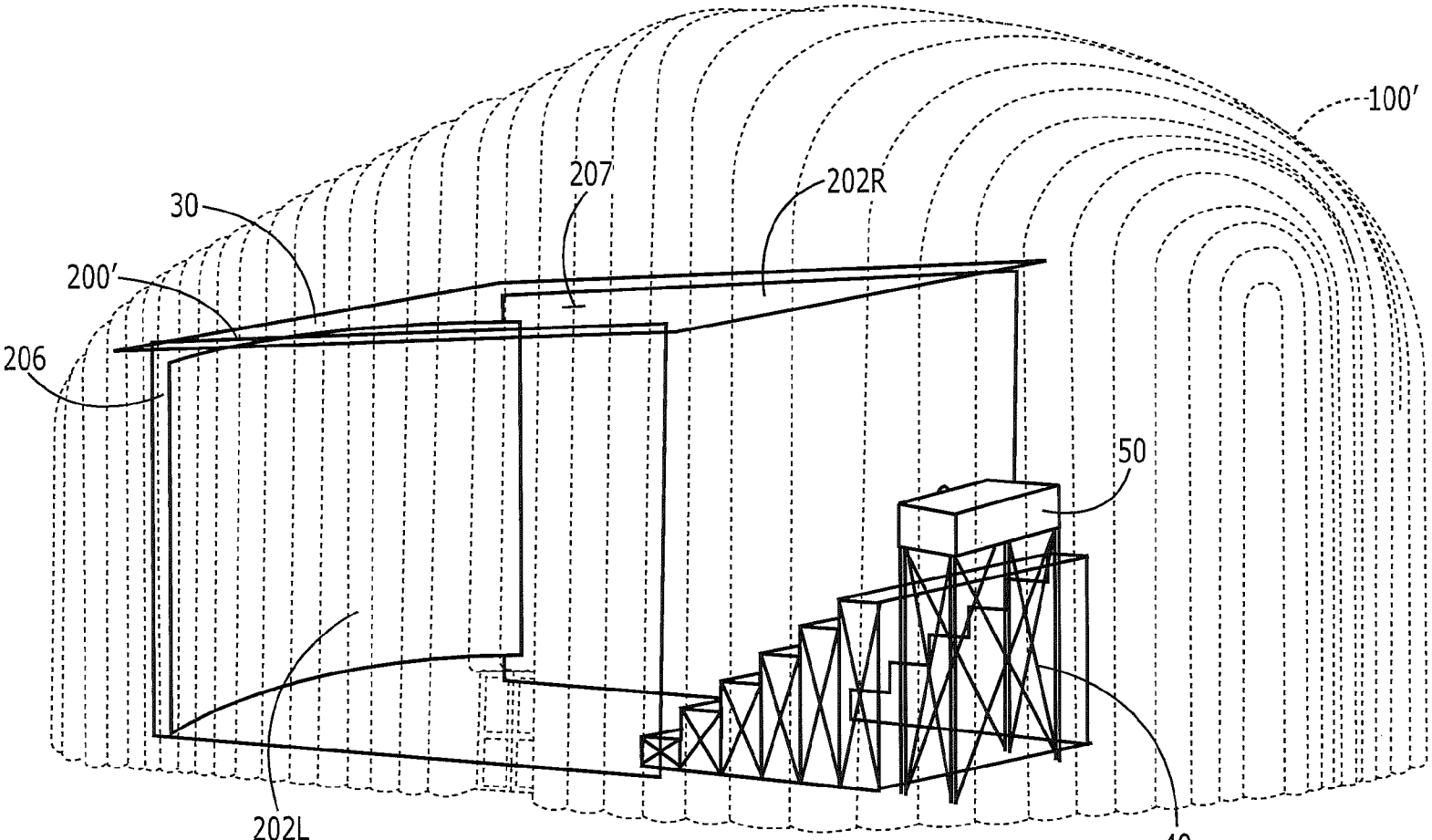
Figure 6C:
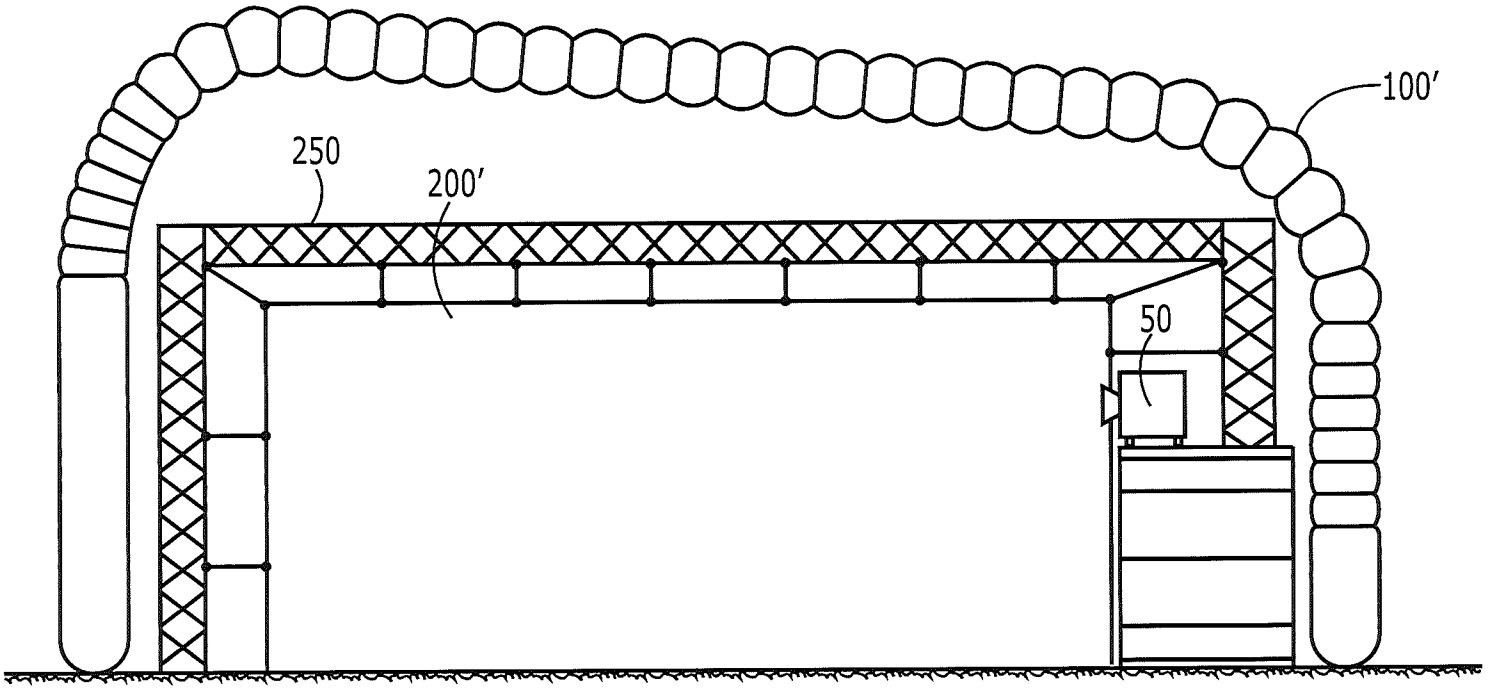

Some embodiments provide a transportable theatre structure having a "box within a box" structure as illustrated generally in FIGS. 6A, 6B and 6C. The box within a box structure generally includes an exterior structure that provides environmental protection for the theatre, while an interior structure that is positioned within the outer structure defines an immersive theatre environment for a viewer seated within the theatre. Both the interior and exterior structures may be easily assembled, disassembled and transported.

For example, in the embodiments illustrated in FIG. 6A, an exterior shell 100' may be provided as an inflatable or non-inflatable structure, and an interior shell 200' can be provided within the exterior shell or structure, wherein the interior shell or structure defines an immersive theatre environment.

The interior shell 200' includes a front wall 206, a rear wall 204, side walls 202R and 202L that extend from the front wall 206 to the rear wall 204, and a ceiling 207 that extends from the top of the front wall 206 to the top of the rear wall 204. A seating structure 40 is provided within the interior structure, and a screen 30 is provided adjacent the front wall 206 so that it is viewable by a viewer seated in the seating structure 40. A projection system 50 is provided near the rear wall 204 of the interior structure, and can be positioned inside or outside the interior shell 200'. For example, the projection system 50 may be positioned within a space between the rear wall 204 of the interior structure and the rear wall of the exterior shell 100'.

The side walls 202R, 220L and the ceiling 207 of the interior shell 200' may be formed of a material and/or lined with a material that is dark and generally non-reflective so as not to be generally visible to a viewer when light within the interior structure is dimmed. In some embodiments, the material of the inner shell 200' may be opaque so as to block any residual light that may penetrate through the exterior shell 100'.

A viewer may thereby not be distracted from a motion picture on the screen 30 by the interior features of the interior shell 200', thereby increasing the immersivity of the viewing experience. For example, the interior surface of the interior shell 200' side walls 202R, 202L and ceiling 207 could be flat black or black in color, or any other dark color, to reduce the amount of presentation light from the screen 30 from being reflected off of the wall and ceiling surfaces.

The material of the interior shell 200' may be a flexible skin attached to a support structure (FIG. 6C).

In some embodiments, the side walls 202R and 202L may have a height that is approximately the same as the height of the screen 30. Moreover, the ceiling 207 may have a width that is approximately the same as the width of the screen 30. A viewer may therefore not perceive a "frame" around the screen during a visual presentation, which may also increase the immersivity of the viewing experience.

In some embodiments, the width between the side walls 202L, 202R may taper inward toward the screen from the rear wall 204 to the front wall 206. In other embodiments, the width between the side walls 202L, 202R may taper outward toward the screen from the rear wall 204 to the front wall 206. In some embodiments, the width between the sidewalls 202L, 202R may be constant from the rear wall 204 to the front wall 206. A direction of taper of the width between the side walls may be chosen to suit the type of viewing experience that is desired. For example, an outward taper may provide a viewer with a more immersive experience by pushing the side walls farther into the peripheral vision of the viewer.

Similarly, in some embodiments, the height of the ceiling 207 may taper downwards or upwards from the rear wall 204 to the front wall 206, or may have a constant height.

The exterior shell 100' may be designed to deal with requirements that differ from the requirements needed of the interior shell 200'. For example, as noted above, the exterior shell 100' may provide environmental protection for the theatre, while the interior shell 200' may define a visually immersive theatre environment for a viewer seated within the theatre. The exterior shell 100' may therefore function to keep out environmental disturbances, such as wind, rain, and/or light, while the interior shell 200' may function to define an interior space that increases the immersive motion picture experience of a viewer by controlling interior visual appearance and reducing external noises.

For example, the interior shell 200' can provide another layer of visual isolation between patrons and the exterior shell 100' so that it is not possible for a viewer in the theatre presentation area to see light leaks and star like effects through the interior shell 200'. In some embodiments, the lining 80 shown in FIG. 5 may be used to line the interior of the exterior shell 100' to act as another opaque layer to reduce or stop pin hole light or other light from getting through. In some embodiments, the exterior shell 100' may be constructed using inflatable tubes in which both the outer panel 64 and the inner panel 66 include an opaque layer. In this configuration, light from two pin holes would have to line up to get through the exterior shell which greatly reduces the amount of light that could get through. Another option to deal with star like effects of inflatable tubes can be to make only the inner panel 66 contain the opaque layer. Since there is not another panel within a near distance on which light from the pin hole lens can shine onto to create a larger light spot, the star like effect will not take place. In a configuration in which the exterior shell is only one wall of flexible skin, more than one layer of opaque material may be required.

The interior shell 200' can be provided with sound absorbing panels or material to improve the audio presentation within the immersive theatre environment. Thus, the interior shell may provides the sound isolation function for the immersive theatre environment while the external shell 100' may provide protection from environmental disturbances.

By separating the demanding requirements for the inner and outer structures, it is possible to provide a more economical transportable theatre that can provide an immersive motion picture experience to a viewer. For example, the exterior shell 100' may be designed to increase structural and environmental soundness, such as shielding from external light, sound and weather, while the interior shell 200' can be designed to increase the immersivity of the viewing experience for theatre patrons by controlling noise/sound experienced by the viewer as well as controlling the shape and size of the visual environment provided to the viewer. As a transportable building system, the attributes of the exterior shell 100' can work in conjunction with attributes associated with the interior shell 200' to improve the viewing experience within the theatre.

In some embodiments, as illustrated in FIG. 6B, the interior shell 200' may exclude certain walls, features or other portions that are outside the field of view of the viewers in the seating structure 40 while looking at an image on the screen. For example, the portion of the interior shell 200' where the image on the screen is projected from does not necessarily require a wall. Provided that undesired light from this area does not influence the image presentation, there is less reason to have a wall at the projection position. Acoustic panels can be provided at the back of the theatre on more open structures, such as scaffolding structures, erected at the rear of the exterior shell 100'.

Still referring to FIG. 6B, the side walls 202L, 202R can be positioned near the sides of the screen 30 and have a similar vertical dimension as the screen 30. The ceiling 207 can be positioned near the top of the screen 30 and have a similar horizontal dimension as the screen 30. The side walls 202L, 202R and ceiling 207 can extend towards the seating structure 40 to the extent of only covering side and top area that can be seen by a viewer's peripheral vision when viewing the presentation on the screen for all seating positions in the seating structure. Thus, the amount of wall and ceiling required to be transported, assembled and disassembled for a transportable theatre may be reduced.

Employing a "box within a box" configuration as described herein can provide a number of significant benefits for a transportable theatre structure. For example, the exterior shell 100' provides a visual layer of isolation so that outside light and visual distractions associated with an environment outside of the exterior shell 100' may not influence the experience of the patron watching a visual presentation within the theatre. Undesirable visual distractions from the outside environment could include city or vehicle lights, external objects and structures that can cast a shadow over the portion of the transportable building. These effects may create a distractive influence on the visual presentation.

The interior surface of the exterior structure may also have visible structural features, and/or a portion of the volume of the space within the exterior shell 100' may house ancillary equipment, such as equipment for lighting, sound, ventilation, etc., and associated support structures. Such features/equipment may be shielded from patrons' view by the interior shell 200' so as not to distract from the visual presentation on the screen.

The exterior shell 100' may be formed of a flexible skin material, such as vinyl, that may flex with outside wind and be a visual distraction during the presentation. When the exterior shell 100' is a flexible structure, such as an inflatable structure, wind may cause relative large interior surfaces of the exterior box to move about. When viewing such moving interior surfaces, some people can be prone to becoming disoriented. Configuring the inside of the exterior shell 100' to minimize visual distractions and to optimize the visual presentation may be difficult.

However, providing an interior shell 200' within the internal volume of the exterior shell 100' can visually isolate the undesirable internal features of the exterior shell 100' and at the same time provide additional visual isolation for the space within the interior shell 200'. By enclosing an inner volume of the theatre to include the presentation screen and the seating section, there can be a significant improvement in presentation quality, so the patron's visual attention remains on the intended visual presentation without the patron being influenced by visual distractions of features that are not a part of the intended visual presentation.

Moreover, a screen 30 within an exterior shell 100' that is not positioned to extend from side to side and from floor to ceiling of the enclosed volume may not appear to be as immersive to an audience member as a screen that does extend from side to side and floor to ceiling. Exterior shells of flexible and transportable structures may not be conducive to optimal rectangular volumes desired for creating immersive cinema experiences with rectilinear or curved rectilinear screens.

Providing the interior shell 200' may allow the screen to extend from side to side and floor to ceiling and thereby increase the immersive experience of the viewer. In essence, a viewer feels the screen is larger when the screen is more enclosed by the volume than when viewing a screen that is much less enclosed by the volume it is within.

The interior shell 200' can also be configured to help with improving the immersive visual presentation experience to ensure the field of view of the patron in the seating section viewing the presentation screen is not able to see unintended distractive features of the exterior shell 100' or features beyond the exterior shell 100'. The shape of the interior shell 200' can be configured so the interior shell 200' side walls 202L, 202R are near the entire length of the edge of the screen 30 and the interior shell 200' ceiling 207 is near the entire length of the top edge of the screen 30. The interior shell 200' side walls 202L, 202R may be spaced apart the same distance at the screen 30 as the portion of the walls next to the seating section. The ceiling 207 may also taper from a lower vertical dimension at the back of the seating section up towards the top edge of the screen 30.

The interior shell 200' can be flexible in shape/configuration to maximize the visual immersive experience for the patron's visual experience. The material to form the interior shell 200' space could be of a flexible material, or a semi flexible material or a rigid material. An example of a flexible and light material that could be used to create the inner box is the use of scrim. A separate structure could be used to hold up the surfaces that define the space of the interior shell 200'.

The exterior shell 100' may also be designed to support the material that defines the space of the interior shell 200'. If the exterior shell 100' is used to support the surface material of the interior shell 200', it may not be possible to prevent the surface material of the interior shell 200' from moving should the exterior shell 100' flex during a windy day. In some embodiments, as illustrated in FIG. 6C, it may be desirable to provide a separate support structure that supports the interior shell 200' such that there is no mechanical connection between the interior shell 200' and the exterior shell 100'. For example, as shown in FIG. 6C, a scaffold support structure 250 is provided within the exterior shell 100' but is not mechanically attached to the walls of the exterior shell 100'. Thus, movement of the walls of the outer structure 100 may not cause corresponding movement of the interior shell 200'.

The interior shell 200' can also be constructed so that in addition to increasing visual isolation from external influences the interior shell 200' could also be constructed to provide a thermal layer of isolation. By increasing the thermal isolation of the interior shell 200' less energy is required to heat and/or cool the volume where the viewers sit compared to heating/cooling the much larger internal volume of the exterior shell 100'. Setting up the transportable theatre with a thermally insulated interior shell 200' in hot or cold locations it becomes possible to more economically heat or cool the screen presentation viewing area. The amount of insulating material for lining the inner box would be substantially less than doing so for inside the exterior shell 100'. The interior shell or structure can also be configured to interface the ventilation duct work with the presentation viewing area.

The inner structure 200 can also be constructed to provide some capability to hang or attach acoustic panels to reduce or suppress noise and or unwanted reflections of sound within the inner structure 200. The acoustic panels can be light weight flexible type materials or made of rigid light weight material. Any acoustical treatment of the inner box may further improve the immersive presentation experience.

Projection System

Referring again to FIG. 2A, a projection system 50 may be provided within the enclosure of the main theatre section 10, along with a raked seating structure 40, the projection screen 30, loudspeakers 46A-46D, and acoustical control features, such as acoustical panels. The projection system 50 and one set of loudspeakers 46C can reside in or on a base structure 52 of the projection system 50, which may include a scaffolding or other support structure. An IMAX® projection system may weigh in excess of 2300 pounds. Thus, the base structure 52 for the projection system 50 may desirably be capable of supporting substantially more than 2300 pounds to support the weight of the projection system 50, one or more projectionists, the rear loudspeakers 46C and other associated equipment.

In current systems, the projection system projects digital 2D or 3D images onto the screen 30 from behind the seating structure 40. The screen 30 may have a curved surface as shown in FIG. 2B as more fully described in U.S. Pat. No. 7,106,411, the disclosure of which is incorporated herein by reference, to increase the immersive visual experience of an image projected by the projection system 50, although a flat screen can be used in some embodiments. The screen 30 may be attached to and supported by a support structure 32, which may be scaffolding, an inflatable screen frame, or other support. To increase the quality of the presentation, the theatre 100 may include a pit section 34 between the seating structure 40 and the screen 30. Acoustical panels and loudspeakers, as described more fully below, may hang from the ceiling and/or interior sidewalls 18 of the main theatre chamber 10.

Figure 7:
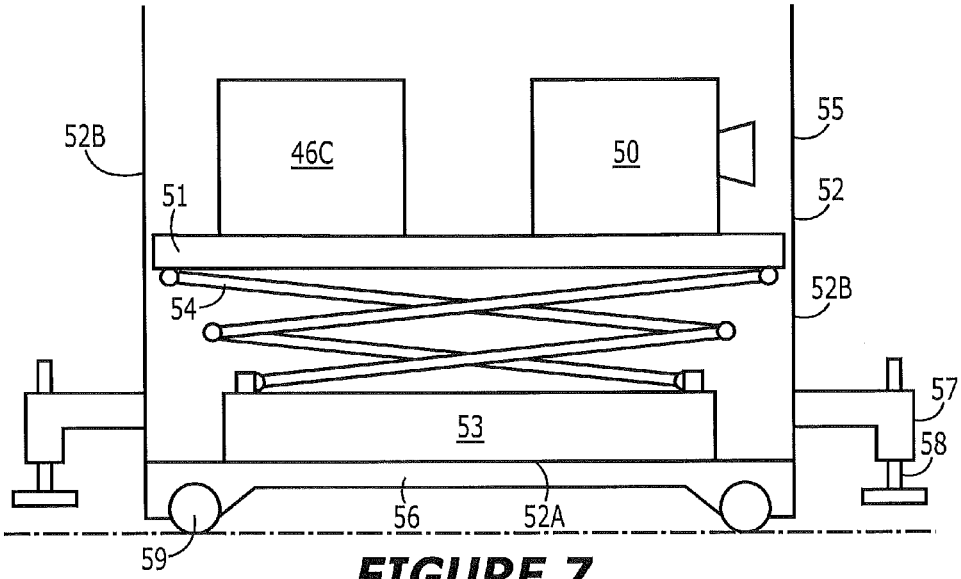
FIGS. 7 and 8 illustrate a movable housing for a projection system for a transportable theatre structure according to some embodiments.
Figure 8:
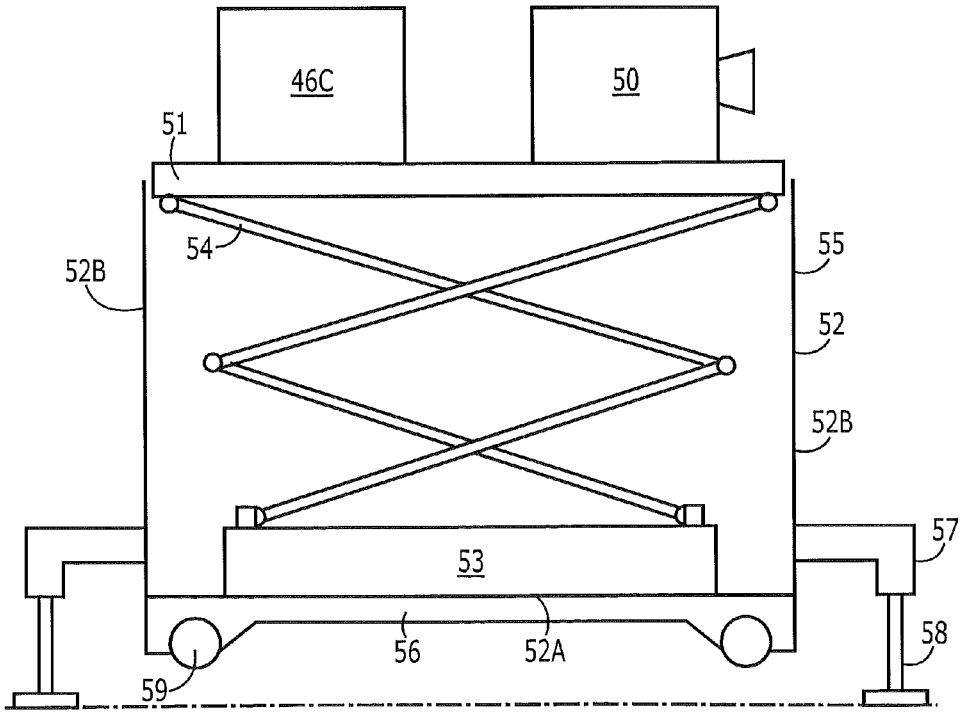

Referring to FIGS. 7 and 8, the projection system 50 and the base structure 52 may be provided in a movable housing or container 55 that can be used to house and protect the projection system 50 and/or one or more loudspeakers 46C during transportation of the theatre structure 100 and can also be used to position the projection system 50 and the loudspeaker (s) 46C for displaying the motion picture. In particular, the projection system 50 may be provided on a movable base 51 within a movable housing 55 including a floor 52A and sidewalls 52B. The movable base 51 may be mounted on a lift system including an actuator 53 and extendable arms 54. The actuator 53 can be hydraulic, pneumatic and/or electromechanical, and can be operated to cause the extendable arms 54 to raise the movable base 51 from a retracted (storage) position shown in FIG. 7 to an extended operational position shown in FIG. 8.

The movable housing 55 may include an undercarriage 56 on which a set of wheels 59 are mounted. The movable housing 55 including the projection system 50 can be rolled into place using the undercarriage 56. A plurality of stabilizing arms 57 and stabilizing feet 58 extend from the movable housing 55 and can be used to lift the movable housing and the wheels 59 into a stable, supported, position for displaying the motion picture. Moreover, the stabilizing feet 58 can be adjusted to ensure that the projection system is level and properly positioned. For example, the stabilizing feet 58 may be threaded and may screw into corresponding threaded apertures in the stabilizing arms 57. In some embodiments, the stabilizing feet 58 and/or the actuator 53 may controlled by an electronic control mechanism that automatically levels the movable housing 53.

Accordingly, the base structure 52 can include a movable housing 55 that may be used for transport and easy setup of the equipment within the theatre. In some embodiments, the projection system 50 and loudspeakers 46C are positioned on the base 51 in such a manner that they need not be moved substantially in a lateral direction for the final theatre setup.

Figure 9A:
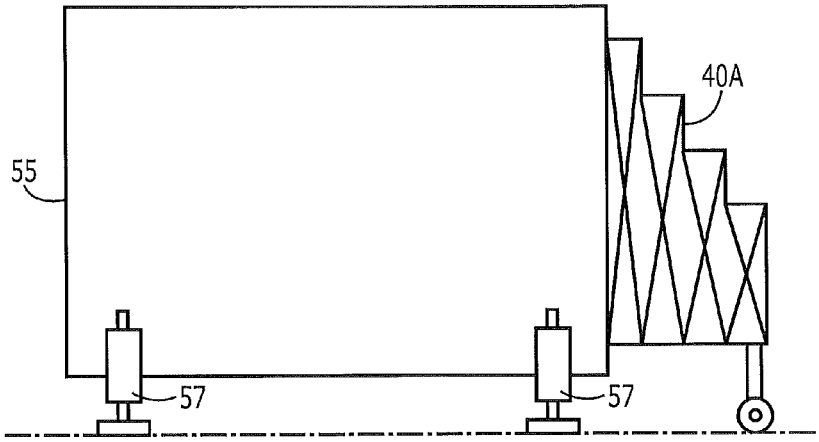
FIGS. 9A and 9B illustrate a movable container for the projection system that includes an attached retractable seating section according to some embodiments.
Figure 9B:
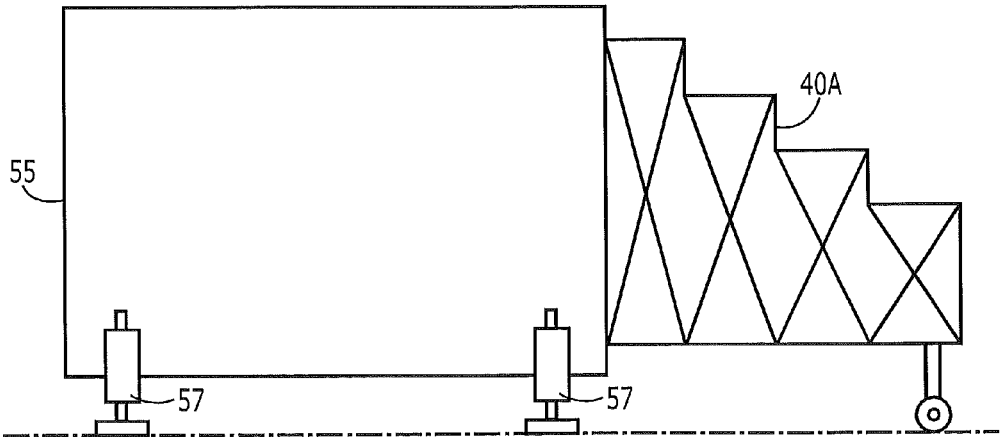

In some embodiments, a retractable portion 40A of the seating structure 40 can be attached to the side of the movable housing 55, as shown in FIGS. 9A (retracted position) and 9B (extended position). During setup, the retractable seating portion 40A may be extended in a direction away from movable housing 52, allowing the retractable seating portion 40A to be set up in its final position relative to the screen 30. Chairs, benches or other seats may be integrally formed in the retractable seating portion 40A, and/or may be installed on the seating portion 40A once it is extended.

Figure 10:
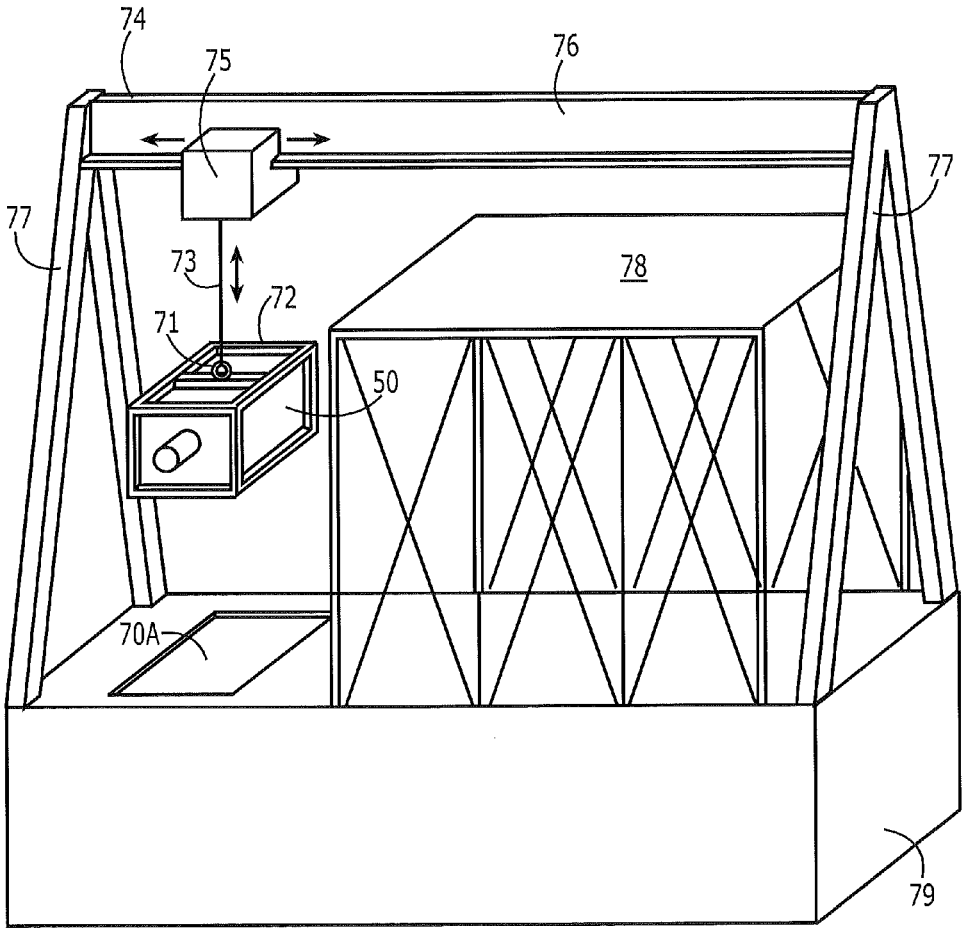
FIG. 10 illustrates a hoist apparatus for positioning a projector in a transportable theatre structure in accordance with some embodiments.

FIG. 10 illustrates systems/methods for storing, transporting, and positioning a projection system within a transportable theatre structure 100. As shown therein, a projection system 50 may be stored within a container 79 that provides protection for the projection system 50 during transportation. The projection system 50 can be stored within a cradle 72 and/or a cradle 72 can be attached to the projection system 50 or formed as an integral part of the projection system 50. The cradle 72 may include a reinforced attachment point 71 by which the cradle 72 can be lifted. Alternatively, the reinforced attachment point 71 can be formed integral with the projection system 50. The projection system 50 can by lifted out of the container 79 through an opening 70A therein by means of a cable 73 or other mechanism attached to the reinforced attachment point 71.

In particular, the projection system 50 can be lifted out of the container 79 using a hoist mechanism 74 that includes a support structure 77 and a support beam 76 suspended on the support structure. The support beam 76 extends above the container 79, and spans both the opening 70A and a platform 78 that may constructed or otherwise provided on the container 79.

The platform 78 may be raised above an upper level of the container 70, for example, by a scaffolding or other support structure.

A movable winch 75 is attached to the support beam 76 and is configured to move laterally along the support beam 76 so that it can be controllably positioned above the opening 70A and/or above the platform 78. The winch 75 raises and lowers the projection system 50 using the cable 73 attached to the attachment point 71 on the cradle 72 and/or the projection system 50.

Accordingly, the hoist mechanism 74 can lift the projection system out of the container 70, move the projection system laterally until it is positioned above the platform 78, and lower the projection system 50 onto the platform 78.

In some embodiments, the container 79 may be sized to hold all of the components of the hoist, including the support structure 77, the support beam 76, the movable winch 75 and the platform 78, in addition to the projection system 50.

Audio System

Two significant challenges associated with designing a transportable inflatable theatre structure are managing noise and optimizing sound reproduction so as to create an immersive motion picture experience (where desired) for the audience members. Accordingly, the acoustic characteristics of the theatre structure 100 may be designed to both reduce the effects of noise generated inside and outside the main theatre chamber 10 and to improve the fidelity of sound reproduction from the loudspeakers as experienced by the audience members within the main theatre structure 10.

Figure 11:
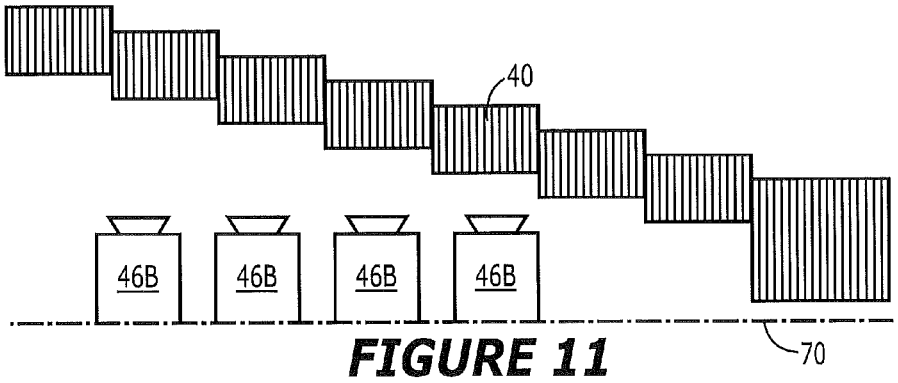
FIG. 11 is a side view of a portion of a raked seating structure of a transportable theatre structure according to some embodiments.

Several embodiments are described which address these challenges. For example, referring to FIG. 11, directional loudspeakers 46B can be placed underneath the seating structure 40. In particular, one or more sub-bass loudspeakers 46B, or an array of sub-bass loudspeakers 46B, may be placed under the seating structure 40. Such placement may reduce the amount of power that needs to be provided to the sub-bass loudspeakers, which may reduce audio leakage from the structure 100 by localizing the sub-bass and adding directionality to the sub-bass signal.

As in conventional IMAX® theatres, three or more loudspeakers 46A may be placed directly behind the screen in the theatre.

Other loudspeakers 46D can be suspended from the pickup members 83 on the ceiling and/or walls of the structure 100, as shown in FIGS. 2A and 3A. The loudspeakers 46A-46D deliver an audio signal associated with the motion picture presentation, or a portion of the audio signal, either in its entirety or as a supplement to the audio produced by the other loudspeakers. In addition, the loudspeakers 46A-46D can be driven as a two dimensional array (front to back, side to side) by delayed and scaled signals so that a sound originating from one of the key loudspeakers (center for example) can be distributed across the array in two dimensions.

An appropriate delay and level reduction may be applied to the signal as it is fed to adjacent loudspeakers—mimicking in two dimensions the spreading wavefront like a ripple on a pond. This is especially applicable to a regular array of loudspeakers on the ceiling. The intended effect is to enhance audio coverage to the seating section and reduce the size and visibility of the loudspeakers (with the disadvantage of increasing the number of loudspeakers). This delay and level reduction would support the spreading wavefront and limit intelligibility loss from mixing of direct and delayed sounds.

The side loudspeakers 46D may be smaller and/or lighter than the other loudspeakers 46A-46C, easier to erect and can reduce the need for scaffolding. Employing multiple loudspeakers opens up the potential of creating artificial acoustics by using them to simulate reflections while at the same time using them to deliver the program. This may be useful in spaces that effectively have no natural acoustics or poor acoustics, such as an inflatable structure.

Further, the multiple loudspeakers can be designed as active acoustical absorbers to control low frequency energy. As is known in the art, a low frequency signal, such as a sub-bass signal having energy in about the 20 to 80 hertz range, is generally non-directional and can penetrate through solid walls. Sub-bass signals can also be very annoying if the rest of the audio signal accompanying the sub-bass signal cannot also be heard. While it is desirable for the audience to hear the sub-bass portion of the audio signal along with the rest of the audio signal, it may not be desirable for persons outside the theatre structure 100 to be able to hear the sub-bass signal, as it may be annoying or distracting. In some embodiments, loudspeakers can be used to control the acoustics of the sub-bass portion of the audio presentation. In particular, selected ones of the loudspeakers 46A to 46D, or other loudspeakers, can be driven with a sub-bass signal (e.g. 20 to 80 Hz) that is 180 degrees out of phase with a sub-bass signal of the audio portion of the presentation to provide an active noise cancelling signal that can cancel and/or focus portions of the sub-bass signal so that the sub-bass signal is limited to the audience area and reduce the amount of the sub-bass signal that can escape from the sides of the theatre structure 100.

In a conventional permanent theatre surround system, multiple small loudspeakers used for the rear channels are mounted to the walls and are driven as groups (no delay or level shift between loudspeakers in a group). See FIG. 4, page 33 of the Digital Cinema Initiatives, LLC, Digital Cinema System Specification, Version 1.2, Mar. 7, 2008, available at www.dcimovies.com, for an example.

Alternatively, a two dimensional array of loudspeakers can be driven by delayed and scaled signals. Optimal placement of the loudspeakers may depend on the geometry of the theatre and may be determined during the design of the structure. In yet another embodiment, the arrayed loudspeakers are used for active control of the room acoustics.

Figure 12:
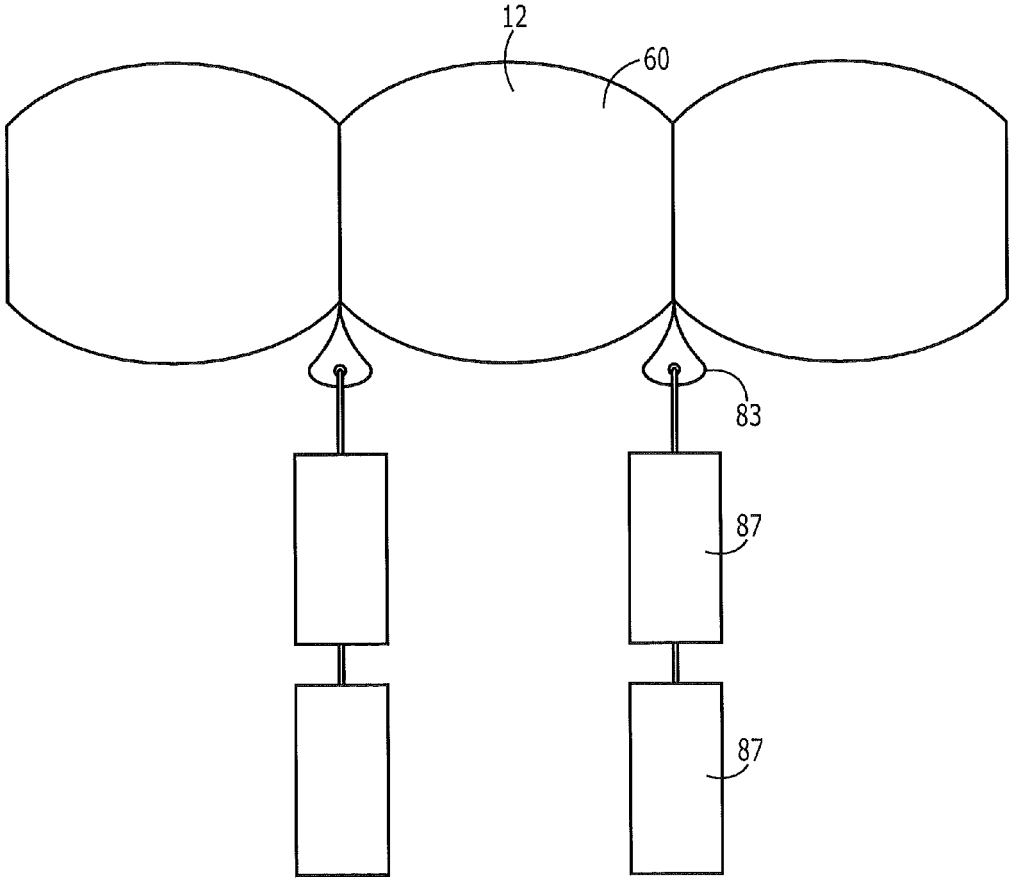
FIG. 12 illustrates acoustical panels suspended from a ceiling of a transportable theatre structure according to some embodiments.

The audio system may be further enhanced through the use of acoustic panels 87 as shown in FIG. 12. The acoustic panels 87 may be hung from one or more attachment points on the ceiling/walls of the theatre structure 100 to reduce or suppress noise and/or unwanted reflections of sound. The acoustic panels can be rectangular, cylindrical, triangular, or have any other desired shape. In order to reduce the load on the pickup members 83 and/or the ceiling/walls of the structure 100, the acoustic panels may be mounted in lightweight vinyl frames.

In addition to placement of loudspeakers under the seating section 40, other loudspeakers can be placed on the sidewalls and/or back wall of the transportable inflatable theatre structure 100.

Loudspeakers and/or acoustic panels can be hung on or mounted in the interior shell or structure 200'.

Setup

To set up the transportable inflatable theatre structure 100, the sections of the structure may be laid out on a field or other support surface and secured. Each section may be attached to stone or concrete blocks or other anchors prior to inflation. The sections may then be secured together according to one or more of the seamless linking structures described above. Next, the sections may be inflated to a predetermined air pressure. For a structure of the size generally described herein, it is expected that inflation may take about 48 hours.

The movable housing 55 and/or container 79 including the projection system 50 may then be moved into place through one of the passageways 15, 25 into the enclosure of the structure 100. The projection system 50 can be positioned about 20 feet over the base of the structure 100 as shown in FIG. 1. Alternatively, for even quicker setup, the projection system 50 can be placed on the ground, such as in the "pit", and angled towards the screen. In this embodiment, the screen is preferably tilted around 5 to 10 degrees depending on the dimensions of the structure towards the direction of the projection system 50, so that light from the projection system 50 can be preferentially reflected by the screen back down toward the audience seating location. The screen may also be placed around midway up in the middle of the seating structure.

The sub-bass loudspeakers 46B placed underneath the seating structure 40 can be placed on rollers and rolled under and out from the seats for easy setup.

Loudspeakers, whether placed behind the seating, under the seating, and/or behind the seating, can be pre-aligned, mounted and placed on skids prior to transportation. Once unloaded within the theatre structure 100, the loudspeakers can be further aligned for optimum audio performance. Alignment systems can be either manual or automatic. If automatic, the loudspeaker alignment systems can be connected to a computer system using wireless or wired technology known in the art. From a graphical interface on the computer, a technician can align each loudspeaker for optimum performance.

Screen

For the large transportable inflatable theatre structure 100, the screen 30 can be 40 by 70 feet, although larger or smaller screens are possible. In some embodiments, however, the screen may be no less than about 50 feet wide.

The screen 30 generally has a curved shape as shown in FIG. 2B. The screen 30 is made of a composition of materials that can provide a similar gain and/or signal to noise ratio performance of screens in current IMAX theatres, but it is much more resilient. In addition, the materials allow the screen 30 to be loosely folded without wrinkling. For example, the screen 30 may be formed from perforated vinyl.

It may be desirable to customize the dimensions of the theatre structure 100 to the actual screen 30 to better provide an immersive experience for audience members. One way to do this is to design the dimensions of the structure 100 to optimize the desired aspect ratios. For example it may be desirable to have the height and width of the interior viewing chamber match the height and width of the screen so that the screen and image appear to extend from wall to wall and from floor to ceiling. In addition, the sidewalls 18 can be vertical to enhance the perception of the screen. Tapering the vertical sidewalls 18 may allow for even better acoustics in the transportable structure 100. Alternatively, scrim can be used to close in the sidewalls 18 decreasing the width of the theatre structure 100 as desired to achieve a specific aspect ratio.

In some embodiments, a screen support structure 32 may be used. The screen support structure 32 can be made of a plurality of inflatable tubes in some embodiments, and in other embodiments can be a scaffolding or other structure. In these embodiments, the inflatable tubes may be interconnected and positioned lying horizontally or alternatively in a vertical position. It is desirable that the screen 30 not move during a presentation. Thus, the tubes may be held in place with cables or other reinforcement. In some embodiments, the back portion of the tubes has three compartments for placement of the side and center screen loudspeakers 46A.

For quick assembling and disassembling of a transportable theatre, a special screen furling system may be desirable. Described hereafter are two methods and systems that allow quick setup of the screen 30 and quick removal of the screen 30 so that the screen 30 can be used again.

Figure 13:
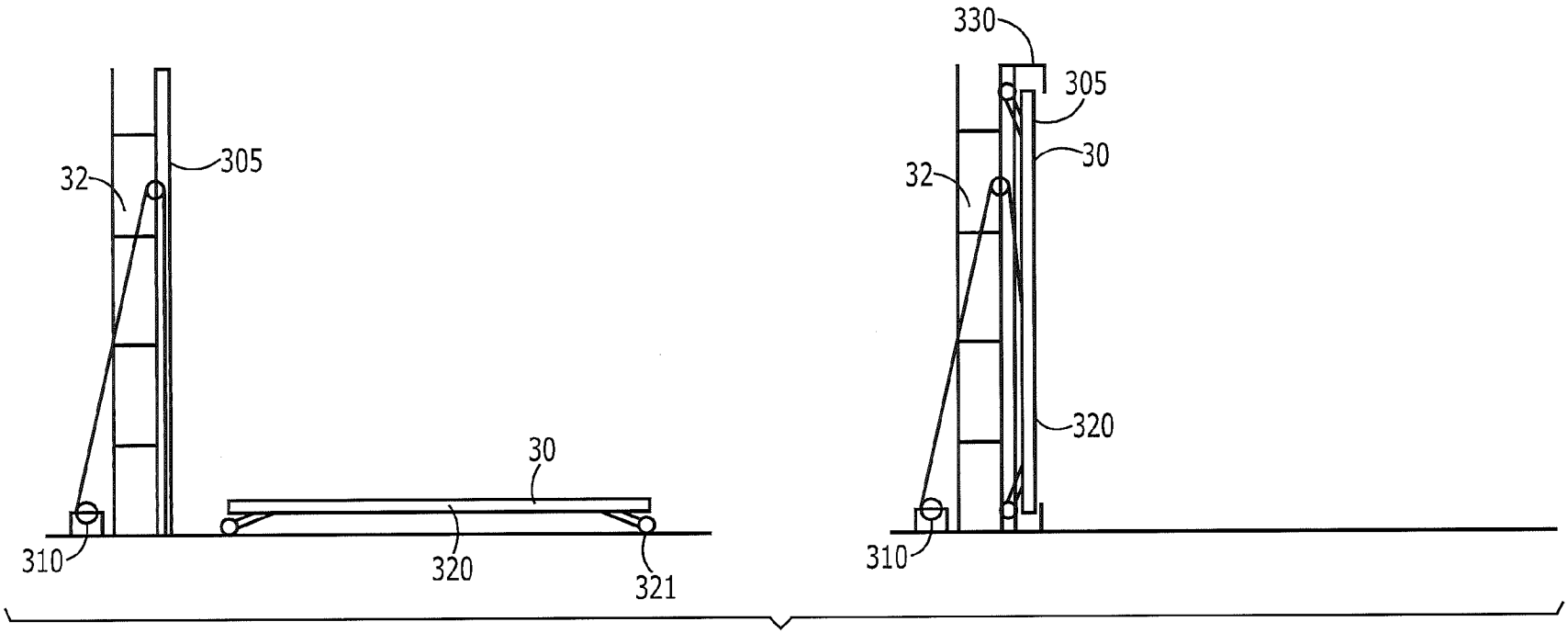
FIGS. 13 and 14 illustrate screen furling systems for transportable theatre structures according to some embodiments.

The screen 30 can be set up from a horizontal configuration as illustrated in FIG. 13. The screen 30 can be unwound from a roll lying horizontally along the theatre floor into a screen perimeter frame 320 that is also lying on the floor. The 30 screen is retained in a grooved track in the frame 320 (similar to a sail in a boom on a sailboat) or it could be held in a carriage track system (as in theatre stage screens) or a combination of both. In order for the screen 30 to slide smoothly into the frame, there may be provided TEFLON® coated straps stretched out under the frame in line with the screen movement.

The perimeter frame (with the screen installed in it) then can be lifted up onto the screen support structure 32. The screen support structure 32 can have a track 305 to guide the perimeter frame 320 into position. The perimeter frame 320 can have rollers 321 along bottom to make the frame roll smoothly on the floor. The perimeter frame 320 including the screen 30 may be lifted into place using a hoist 310 or other lifting mechanism. Thus, the screen 30 can be put in place without requiring anyone to climb the screen support structure 32. Once the screen 30 is lifted into place, the frame 320 may be held in place via retaining members 330.

To uninstall the screen 30, the steps described above may be performed in reverse. The screen roll is stored in a suitable crate or case.

Figure 14:
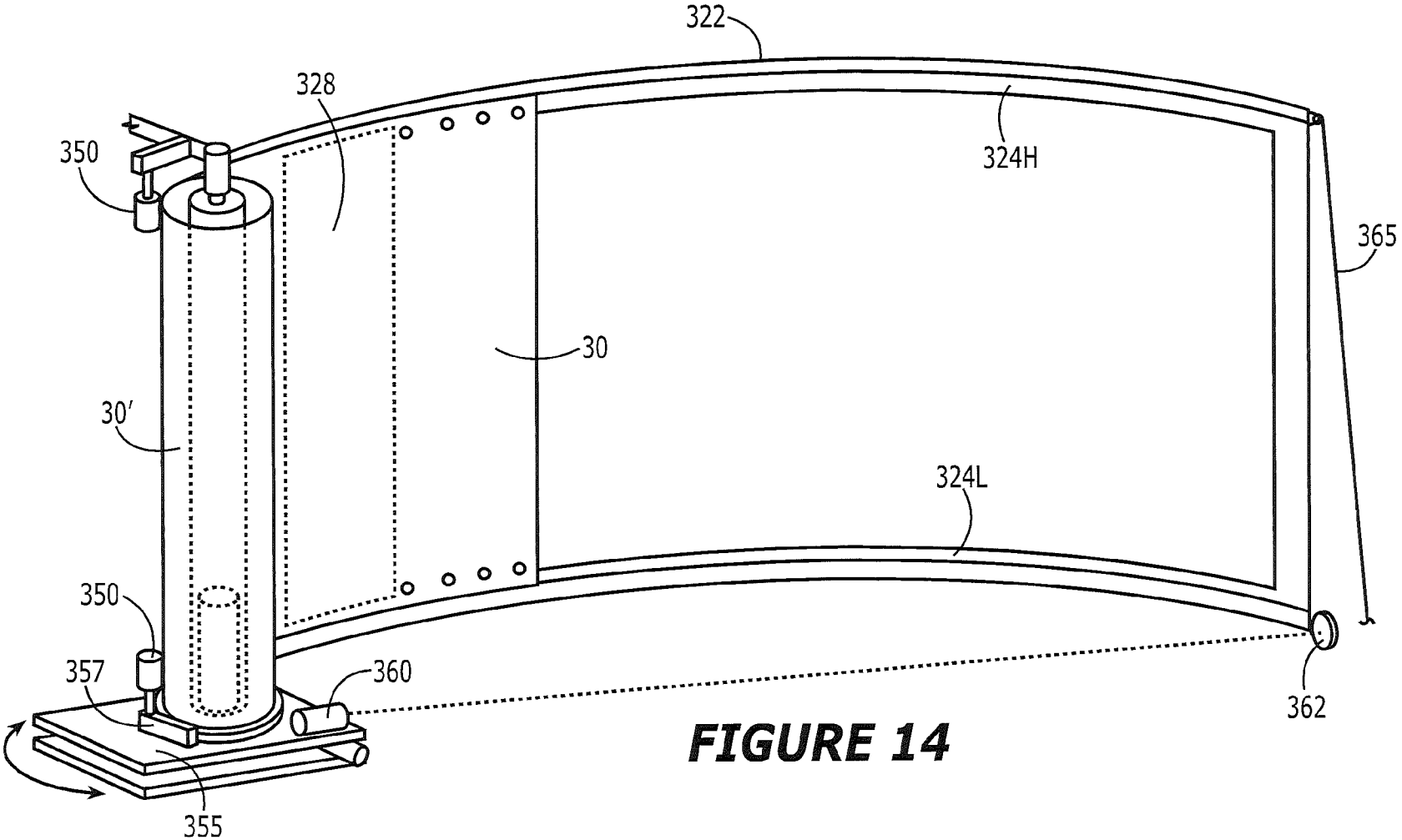

In some embodiments, the screen 30 can be installed and removed vertically, as illustrated in FIG. 14. In this embodiment, the screen 30 is stored as a roll 30'. The screen roll is stood on end using a hinged base plate 355 with a spinning support disc 357. The screen 30 may be pulled using a pull-cord 365, causing the roll 30' to unwind into the screen frame 322 where it can be held in upper and lower grooved tracks 324H, 324L. An alternative screen retention can be a carriage track system used in theatre stage screens. The screen 30 can be tensioned through the use of lacing along the sides and/or bottom of screen frame. To keep the screen edges perpendicular to the screen roll, a laser 360 can be mounted at the roll 30' and a beam sent to a target 362 along the screen edge. Target feedback is used to move the screen roll axle and adjust screen roll perpendicularly with screen edge(s). During screen winding or unwinding, protective material 328, such as thin foam strips or a protective foam sheet, can be wound in with the screen and sandwiched between the screen layers to protect the screen surface from abrasion.

Screen removal may involve winding the screen 30 into a roll 30' again. Tension is maintained via tight-wind rollers 350 (like in film magazines). To keep the screen 30 aligned along top and bottom edges a laser is mounted at the base and a beam sent to a target along the screen bottom. Target feedback is used to move the screen base and adjust the screen roll perpendicularity with the screen bottom edge. During screen winding thin, foam strips 328 are wound in and sandwiched between the screen layers to protect the screen surface from abrasion. The screen roll 30' can then be stored in a suitable crate or case.

Transportation

Figure 15:
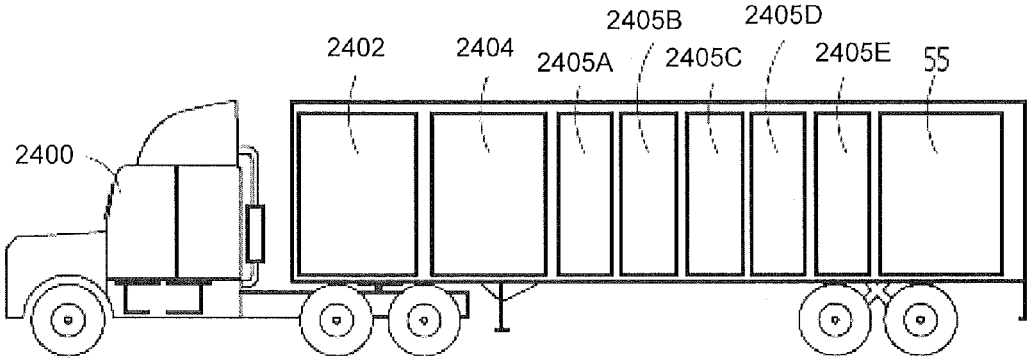
FIG. 15 illustrates packing of various portions of a transportable theatre structure according to some embodiments in separate containers for shipping on a tractor-trailer.

A transportable inflatable theatre structure 100 according to some embodiments can be disassembled and packed into crates for ease of transportation. In particular, the various sections and/or systems of the structure 100 can each be packed into its own crate for transportation, for example, on the bed of a tractor-trailer, a railway boxcar or other mode of transportation. Referring to FIG. 15, a tractor-trailer rig 2400 including packing crates 2402, 2404, and 2405A to 2405E is illustrated. Each of the building sections can be packed into its own crate 2405A to 2405E. The movable housing 55 containing the projection system 50 may be loaded onto the tractor-trailer 2400. A crate 2402 may hold the screen support structure, while a crate 2404 may hold the audio system for the theatre 100. The seating structure 40 may be disassembled and stored in separate containers.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and are not intended to be interpreted in an idealized or overly formal sense unless expressly so defined herein.

Embodiments of the invention are described herein with reference to schematic illustrations of embodiments of the invention. The thickness of layers, walls, features and regions in the drawings may be exaggerated for clarity. Additionally, variations from the shapes of the illustrations as a result, for example, of manufacturing techniques and/or tolerances, are to be expected. Thus, embodiments of the invention should not be construed as limited to the particular shapes of layers, walls, features and regions illustrated herein but are to include deviations in shapes that result, for example, from manufacturing.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and sub combinations of the embodiments described herein, and of the manner and process of making and using them, and shall support claims to any such combination or subcombination.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A transportable theatre system comprising:

an exterior shell comprising a flexible material that defines a first inner volume within the exterior shell; and an inner shell within the exterior shell that defines a second inner volume within the inner shell, wherein the second inner volume is enclosed by the first inner volume, wherein the inner shell comprises:

a first surface comprising a support structure that is spaced apart from the exterior shell, the first surface comprising a side edge having a height and a top edge having a width; and a second surface comprising a portion proximate the side edge of the first surface that has a similar height as the first surface, the second surface further comprising a portion proximate the top edge of the first surface that has a similar width as the first surface;

wherein the first surface is configured as a viewing screen for viewing a projected presentation and the second surface is configured to absorb light;

wherein the second inner volume creates a wall-to-wall and a floor-to-ceiling immersive experience with the screen within the first inner volume and provides an increased immersive cinematic experience to a patron positioned to view the projected presentation within the second inner volume.

2. The transportable theatre system of claim 1, wherein the inner shell is mechanically supported independent of the exterior shell.

3. The transportable theatre system of claim 1, wherein a volume of space between the exterior shell and the inner shell houses audiovisual systems that provide the immersive cinematic experience within the second inner volume.

4. The transportable theatre system of claim 1, further comprising:

a seating section within the second inner volume.

5. The transportable theatre system of claim 4, wherein the second surface of the inner shell comprises a side wall that extends along a side of the seating section and is proximate to a side edge of the viewing screen and the second surface of the inner shell comprises a ceiling that extends over the seating section and is proximate to a top edge of the viewing screen.

6. The transportable theatre system of claim 5, wherein the side wall is proximate to the side edge of the first surface and the ceiling is proximate to the top edge of the first surface.

7. The transportable theatre system of claim 5, wherein the ceiling slopes up to the top of the top edge of the viewing screen from a back of the theatre opposite the viewing screen to a front of the theatre proximate to the viewing screen.

8. The transportable theatre system of claim 5, wherein the ceiling is horizontal.

9. The transportable theatre system of claim 4, wherein the second surface of the inner shell comprises side walls on opposing sides of the viewing screen, wherein the side walls are spaced a same distance apart from one another at a back of the theatre opposite the viewing screen as at a front of the theatre proximate to the viewing screen.

10. The transportable theatre system of claim 4, wherein:

the second surface of the inner shell comprises side walls on opposing sides of the viewing screen and that extend to the seating section; and the second surface of the inner shell comprises a ceiling that extends over the seating section and is proximate to a top edge of the viewing screen.

11. The transportable theatre system of claim 1, wherein the inner shell comprises a flexible material or a rigid material.

12. The transportable theatre system of claim 1, wherein the inner shell comprises scrim.

13. The transportable theatre system of claim 1, wherein the exterior shell comprises an inflatable structure.

14. The transportable theatre system of claim 1, wherein a shape of the inner shell can be configured to form a different shape than the shape of the first inner volume.

15. The transportable theatre system of claim 1, wherein the inner shell material comprises a thermally insulating material.

16. The transportable theatre system of claim 1, wherein the exterior shell and the inner shell cooperatively function to shield the second inner volume from light incident on an outer surface of the exterior shell to substantially preclude pin hole light that may penetrate through the exterior shell from reaching the second inner volume.

17. The transportable theatre system of claim 1, wherein the exterior shell comprises first and second opaque layers of material that are spaced a predetermined distance apart, wherein light passing through a pin hole lens in the first opaque layer of material is blocked by the second opaque layer of material in the external shell.

18. The transportable theatre system of claim 1, wherein the exterior shell provides a barrier to weather precipitate and outside light and the inner shell is configured to reduce sound reflections within the second inner volume.

19. The transportable theatre system of claim 1, wherein the transportable theatre system is configured to be disassembled, transported and reassembled.

20. The transportable theatre system of claim 1, wherein the second inner volume is independent of the shape of the exterior shell.

* * * * *